US011933544B2

(12) United States Patent
Ohta et al.

(10) Patent No.: US 11,933,544 B2
(45) Date of Patent: Mar. 19, 2024

(54) REFRIGERATION DEVICE

(71) Applicant: PHC HOLDINGS CORPORATION, Tokyo (JP)

(72) Inventors: Akihiro Ohta, Saitama (JP); Hiroyuki Sato, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 372 days.

(21) Appl. No.: 17/198,087

(22) Filed: Mar. 10, 2021

(65) Prior Publication Data

US 2021/0190436 A1 Jun. 24, 2021

Related U.S. Application Data

(63) Continuation of application No. PCT/JP2019/029757, filed on Jul. 30, 2019.

(30) Foreign Application Priority Data

Sep. 11, 2018 (JP) ..... 2018-169898

(51) Int. Cl.
*F28D 15/02* (2006.01)
*F25D 11/02* (2006.01)
(Continued)

(52) U.S. Cl.
CPC ..... *F28D 15/0275* (2013.01); *F25D 11/025* (2013.01); *F25D 17/02* (2013.01);
(Continued)

(58) Field of Classification Search
CPC ..... F28D 15/0275; F28D 2021/0068; F25D 11/025; F25D 17/02; F25D 23/068; F25D 2331/00; F25D 2600/04; F25B 25/005
See application file for complete search history.

(56) References Cited

U.S. PATENT DOCUMENTS 10,520,230 B2 * 12/2019 Edwards ..... F28D 15/0275
2005/0109057 A1 5/2005 Sone
2019/0178558 A1 * 6/2019 Berchowitz ..... F25B 25/005

FOREIGN PATENT DOCUMENTS

JP 2005-156011 A 6/2005

OTHER PUBLICATIONS

International Search Report issued in corresponding International Patent Application No. PCT/JP2019/029757, dated Sep. 1, 24, 2019, with English translation.

* cited by examiner

*Primary Examiner* — Tavia Sullens
*Assistant Examiner* — Khaled Ahmed Ali Al Samiri
(74) *Attorney, Agent, or Firm* — Rimon PC

(57) ABSTRACT

An evaporation unit includes a first and second pipe conduits. The first and second pipe conduits each include a near-end part, a long circumference part, a junction part, a short circumference part, and a far-end part. Around a storage chamber, the first long circumference part extends in a first direction, the first junction part turns, and the first short circumference part extends in the first or second direction. The second short circumference part extends in the first direction, the second junction part turns, and the second long circumference part extends in the first or second direction. The first and second turning part located at the same position counted from the respective near-end part sides are disposed respectively on wall surfaces facing each other.

16 Claims, 15 Drawing Sheets

(51) Int. Cl.
*F25D 17/02* (2006.01)
*F25D 23/06* (2006.01)

(52) U.S. Cl.
CPC ..... *F25D 23/068* (2013.01); *F25D 2331/00* (2013.01); *F25D 2600/04* (2013.01)

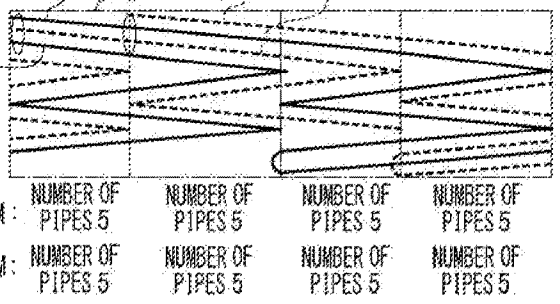
FIG. 12A
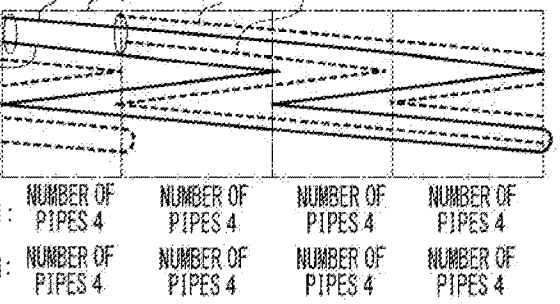
FIG. 12B
FIG. 12C
FIG. 12D
FIG. 12E
FIG. 12F

REFRIGERATION DEVICE

CROSS-REFERENCE TO RELATED APPLICATIONS

This application is the Continuation Application of International Patent Application No. PCT/JP2019/029757, filed on Jul. 30, 2019, which claims the benefit of priority from the prior Japanese Patent Application No. 2018-169898, filed on Sep. 11, 2018, the entire content of each of which is incorporated herein by reference.

BACKGROUND

Field of the Invention

The present invention relates to refrigeration devices, and particularly to a refrigeration device that condenses a refrigerant and then evaporates the refrigerant to exert a cooling effect.

Description of the Related Art

There has been conventionally known a refrigeration device that performs heat exchange between a refrigerator and a storage chamber via a thermosiphon connected to a cooling unit of the refrigerator (see Patent Literature 1, for example). In the refrigeration device disclosed in Patent Literature 1, a pipe of a thermosiphon includes two paths, and each of the paths is structured to extend downward along a different half circumference of a storage chamber. In this refrigeration device, by increasing the inclination angle of each pipe path, prevention of the flow of the refrigerant in the pipe can be avoided even when the low-temperature storage is tilted.

[Patent Literature 1] Japanese Unexamined Patent Application Publication No. 2005-156011

A storage chamber of a low-temperature storage is required to stably maintain the low-temperature state. Accordingly, in such a low-temperature storage, various measures are adopted in order to restrain temperature rise within the storage chamber. For example, the storage chamber is covered with a thermal insulation material having high thermal insulation properties. Also, a door through which storage objects are transferred into and from the storage chamber is configured as a double door. The inner door is divided into multiple parts such that the area of an opening used for transfer of a storage object is reduced. Also, an alarm is set to sound when the door remains open for a predetermined period of time or longer, so as to alert the user. Further, as a countermeasure to a temporary power failure, an auxiliary cooling source, such as liquefied gas, is provided to restrain temperature rise within the storage chamber.

As a result of intensive study regarding refrigeration devices mounted on low-temperature storages, the inventors have found that, with regard to conventional refrigeration devices, there is room for improvement in stably maintaining the temperatures in the low-temperature storages.

SUMMARY OF THE INVENTION

The subject application has been made in view of such a situation, and a purpose thereof is to provide a technology for further stabilizing the temperature in a low-temperature storage.

In response to the above issue, one embodiment in the subject application is a refrigeration device. The refrigeration device includes: a refrigerator; and a heat pipe that includes a condensation unit, a pipe unit, and an evaporation unit, in which the condensation unit is connected with the refrigerator such that heat exchange therewith can be performed to condense a refrigerant, the pipe unit circulates the refrigerant between the condensation unit and the evaporation unit, and the evaporation unit extends along wall surfaces of a storage chamber, which houses a preservation object, and is attached to the wall surfaces such that heat exchange therewith can be performed to evaporate the refrigerant. The evaporation unit includes a first pipe conduit and a second pipe conduit. The first pipe conduit includes a first near-end part located closer to the condensation unit, a first far-end part located opposite to the first near-end part, and a first long circumference part, a first short circumference part, and a first junction part that are arranged between the first near-end part and the first far-end part. The second pipe conduit includes a second near-end part located closer to the condensation unit, a second far-end part located opposite to the second near-end part, and a second long circumference part, a second short circumference part, and a second junction part that are arranged between the second near-end part and the second far-end part. The first near-end part in the first pipe conduit is positioned higher than the second near-end part, and, in the first pipe conduit, the first long circumference part is located closer to the first near-end part, the first short circumference part is located closer to the first far-end part, and the first junction part is located between the first long circumference part and the first short circumference part. The first long circumference part extends around the storage chamber from the first near-end part side toward the first far-end part side in a first circumference direction, and also extends along more wall surfaces than the first short circumference part. The first junction part includes at least one first turning part that changes the circumference direction of the first pipe conduit. The first short circumference part extends around the storage chamber from the first near-end part side toward the first far-end part side, extends in the first circumference direction when the number of the first turning parts is even, extends in a second circumference direction, which is opposite to the first circumference direction, when the number of the first turning parts is odd, and extends along fewer wall surfaces than the first long circumference part. The second near-end part in the second pipe conduit is positioned lower than the first near-end part, and, in the second pipe conduit, the second short circumference part is located closer to the second near-end part, the second long circumference part is located closer to the second far-end part, and the second junction part is located between the second short circumference part and the second long circumference part. The second short circumference part extends around the storage chamber from the second near-end part side toward the second far-end part side in the first circumference direction, and also extends along fewer wall surfaces than the second long circumference part. The second junction part includes a second turning part that changes the circumference direction of the second pipe conduit and that is equal in number to the first turning part. The second long circumference part extends around the storage chamber from the second near-end part side toward the second far-end part side, extends in the first circumference direction when the number of the second turning parts is even, extends in the second circumference direction when the number of the second turning parts is odd, and extends along more wall surfaces than the second short circumference part. The first turning part positioned N-th counted from the first near-end part side and the second turning part positioned N-th counted from the second near-end part side are disposed respectively on wall surfaces facing each other, where N is an integer greater than or equal to 1.

Optional combinations of the aforementioned constituting elements, and implementation of the present invention, including the expressions, in the form of methods, apparatuses, or systems may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIGS. 12A, 12B, 12C, 12D, 12E, and 12F are schematic diagrams that each illustrate a state where the wall surfaces of a storage chamber are developed;

DETAILED DESCRIPTION OF THE INVENTION

Figure 1:
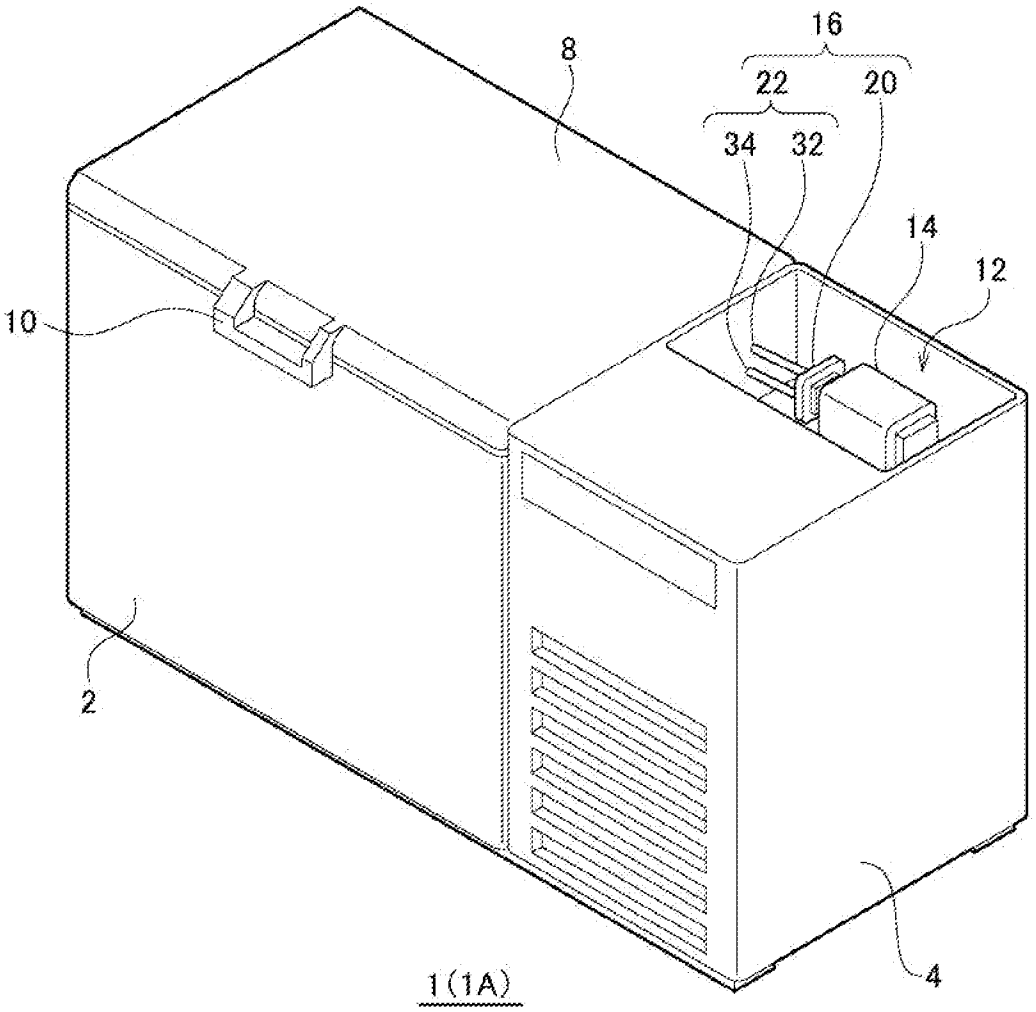
FIG. 1 is a perspective view of a low-temperature storage provided with a refrigeration device according to a first embodiment.

The invention will now be described by reference to the preferred embodiments. This does not intend to limit the scope of the present invention, but to exemplify the invention.

In the following, the present invention will be described based on preferred embodiments with reference to the drawings. The embodiments are intended to be illustrative only and not to limit the invention, so that it should be understood that not all of the features or combinations thereof described in the embodiments are necessarily essential to the invention. Like reference characters denote like or corresponding constituting elements, members, and processes in each drawing, and repetitive description will be omitted as appropriate. Also, the scale or shape of each component shown in each drawing is defined for the sake of convenience to facilitate the explanation and is not to be regarded as limitative unless otherwise specified. When the terms "first", "second", and the like are used in the present specification or claims, such terms do not imply any order or degree of importance and are used to distinguish one configuration from another, unless otherwise specified. Further, in each drawing, part of a member less important in describing embodiments may be omitted.

First Embodiment

Figure 2:
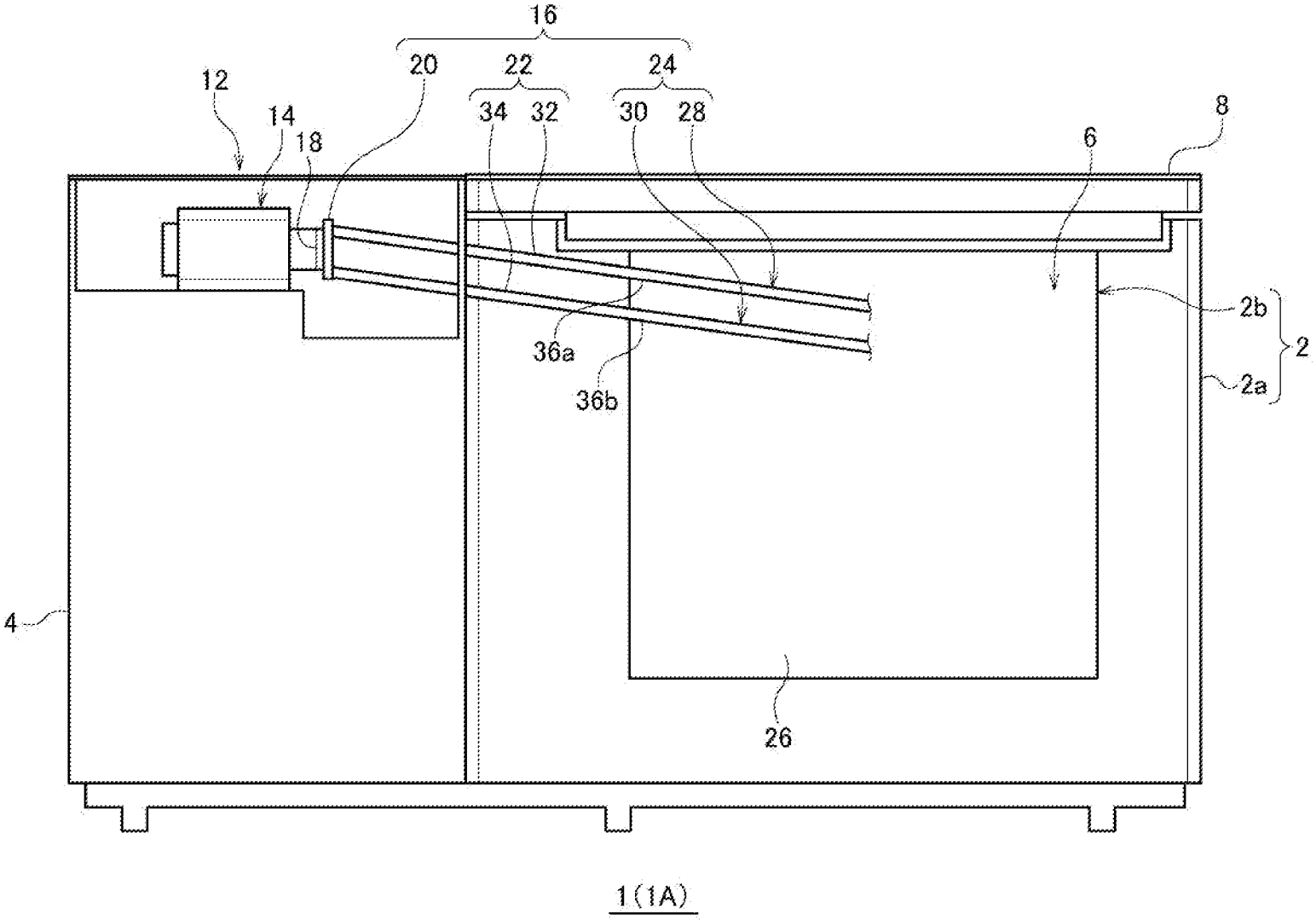
FIG. 2 is a rear view of the low-temperature storage.

FIG. 1 is a perspective view of a low-temperature storage provided with a refrigeration device according to a first embodiment. FIG. 2 is a rear view of the low-temperature storage. FIG. 2 illustrates a state in which the inside of the low-temperature storage is transparently viewed. Also, the evaporation unit of the heat pipe is only partially illustrated. A low-temperature storage 1 (1A) is used for low-temperature preservation of biological materials, such as cells and body tissues, drugs, and reagents, for example. The low-temperature storage 1 includes a thermally insulated box 2 of which an upper surface is open, and a machine chamber 4 disposed adjacent to the thermally insulated box 2.

The thermally insulated box 2 includes an outer box 2*a* and an inner box 2*b* of which upper surfaces are both open. A space between the outer box 2*a* and the inner box 2*b* is filled with a thermal insulation material, which is not illustrated. The thermal insulation material may be a polyurethane resin, glass wool, or a vacuum insulation material, for example. A space within the inner box 2*b* constitutes a storage chamber 6. The storage chamber 6 is a space for housing a preservation object. A target temperature inside the storage chamber 6 (hereinafter, referred to as a storage inside temperature, as appropriate) may be −50 degrees C. or lower, for example.

On the upper surface of the thermally insulated box 2, a thermally insulated door 8 is provided via a packing. The thermally insulated door 8 is fixed at one end to the thermally insulated box 2 and provided to be rotatable about the one end. Accordingly, the opening of the storage chamber 6 is covered such as to be openable and closable. On the other end side of the thermally insulated door 8, a handle part 10 is provided and used for open and close operations for the thermally insulated door 8. On wall surfaces 26 on the thermal insulation material side of the inner box 2*b*, an evaporation unit 24 of a heat pipe 16, which will be described later, is provided. The inside of the storage chamber 6 is cooled by means of evaporation of a refrigerant in the evaporation unit 24.

The machine chamber 4 is a space for housing a refrigeration device 12 of the present embodiment. However, part of a pipe unit 22 and the evaporation unit 24 of the heat pipe 16 in the refrigeration device 12 are arranged within the thermally insulated box 2. Since the structures of the thermally insulated box 2 and the machine chamber 4 are publicly known, further detailed description therefor will be omitted.

The refrigeration device 12 is a device capable of cooling the inside of the storage chamber to an ultra-low temperature of −50 degrees C. or lower. The refrigeration device 12 includes a refrigerator 14 and the heat pipe 16.

The refrigerator 14 is a device for cooling a condensation unit 20 of the heat pipe 16. As the refrigerator 14, a conventionally well-known refrigerator may be used, such as a Gifford-McMahon (GM) refrigerator, a pulse tube refrigerator, a Stirling refrigerator, a Solvay refrigerator, a Claude cycle refrigerator, and a Joule-Thomson (JM) refrigerator. The refrigerator 14 includes a cooling unit 18 that absorbs external heat. Since the structure of the refrigerator 14 is publicly known, further detailed description therefor will be omitted.

The heat pipe 16 is a device for cooling an object to be cooled by means of the heat of vaporization of a refrigerant. The heat pipe 16 mediates heat exchange between the cooling unit 18 of the refrigerator 14 and the inside of the storage chamber 6. The heat pipe 16 includes the condensation unit 20, the pipe unit 22, and the evaporation unit 24.

The condensation unit 20 is connected with the cooling unit 18 of the refrigerator 14 such that heat exchange therewith can be performed. The heat exchange between the condensation unit 20 and the cooling unit 18 cools the refrigerant within the condensation unit 20, so that the refrigerant is condensed to liquid. For example, the condensation unit 20 may include a condensation fin connected to the cooling unit 18 and also include a refrigerant passage constituted by grooves of the condensation fin. The cold of the cooling unit 18 is transmitted, via the condensation fin, to the refrigerant flowing through the refrigerant passage. The gaseous refrigerant liquefies in the refrigerant passage. As the refrigerant, a refrigerant gas, such as R740 (argon), R50 (methane), R14 (tetrafluoromethane), and R170 (ethane), may be used.

One end of the pipe unit 22 is connected to the condensation unit 20. More specifically, one end of the pipe unit 22 is connected to the refrigerant passage of the condensation unit 20. Also, the other end of the pipe unit 22 is connected to the evaporation unit 24. The refrigerant within the heat pipe 16 is circulated between the condensation unit 20 and the evaporation unit 24 through the pipe unit 22.

The evaporation unit 24 is connected thermally to the inside of the storage chamber 6 such that heat exchange therewith can be performed. More specifically, the evaporation unit 24 has a tubular shape and extends along the wall surfaces 26 on the thermal insulation material side of the inner box 2*b*, i.e., the wall surfaces 26 of the storage chamber 6. The evaporation unit 24 is attached to the wall surfaces 26 such that heat exchange therewith can be performed, so as to evaporate the refrigerant. The evaporation unit 24 may be fixed to the wall surfaces 26 directly or via a heat transfer material, for example.

The refrigerant liquefied in the condensation unit 20 flows into the evaporation unit 24 through the pipe unit 22. The refrigerant in the evaporation unit 24 then absorbs heat from the inside of the storage chamber 6 to evaporate. Such evaporation of the refrigerant cools the inside of the storage chamber 6. The refrigerant gasified in the evaporation unit 24 flows into the refrigerant passage of the condensation unit 20 through the pipe unit 22. Thereafter, the refrigerant in the condensation unit 20 is condensed again to liquid.

The evaporation unit 24 includes a first pipe conduit 28 and a second pipe conduit 30. Also, the pipe unit 22 includes a first pipe 32 and a second pipe 34. To the condensation unit 20, one end of the first pipe 32 and one end of the second pipe 34 are connected. Further, the other end of the first pipe 32 is connected to one end of the first pipe conduit 28, and the other end of the second pipe 34 is connected to one end of the second pipe conduit 30. Thus, the first pipe conduit 28 and the second pipe conduit 30 are connected to the same refrigerator 14. The boundary between the pipe unit 22 and the evaporation unit 24 corresponds to a boundary between an area where the heat pipe 16 is in contact with the wall surfaces 26 and an area where the heat pipe 16 is not in contact with the wall surfaces 26, for example. In other words, in the piping of the heat pipe 16, a portion in contact with the wall surfaces 26 corresponds to the evaporation unit 24, and a portion not in contact with the wall surfaces 26 corresponds to the pipe unit 22. The other end of the first pipe conduit 28 and the other end of the second pipe conduit 30 are connected with each other via a connecting pipe 50, which will be described later.

Part of the refrigerant from the condensation unit 20 flows into the first pipe conduit 28 of the evaporation unit 24 through the first pipe 32. The part of the refrigerant exchanges heat with wall surfaces 26 overlapped by the first pipe conduit 28 to reach an end part located opposite to the pipe unit 22 side. Part of the refrigerant that has evaporated and gasified during the process returns to the condensation unit 20 through the first pipe 32. Accordingly, the liquid refrigerant and the gaseous refrigerant flow in the opposite directions within the first pipe conduit 28 and the first pipe 32. At the time, the liquid refrigerant flows near the outer side of the pipe, and the gaseous refrigerant flows near the center of the pipe.

Meanwhile, another part of the refrigerant from the condensation unit 20 flows into the second pipe conduit 30 of the evaporation unit 24 through the second pipe 34. The another part of the refrigerant exchanges heat with wall surfaces 26 overlapped by the second pipe conduit 30 to reach an end part located opposite to the pipe unit 22 side. Part of the refrigerant that has evaporated and gasified during the process returns to the condensation unit 20 through the second pipe 34. Accordingly, the liquid refrigerant and the gaseous refrigerant flow in the opposite directions within the second pipe conduit 30 and the second pipe 34. At the time, the liquid refrigerant flows near the outer side of the pipe, and the gaseous refrigerant flows near the center of the pipe. Thus, the refrigeration device 12 includes a first refrigerant circulation passage including the first pipe 32 and the first pipe conduit 28, and a second refrigerant circulation passage including the second pipe 34 and the second pipe conduit 30.

Figure 3:
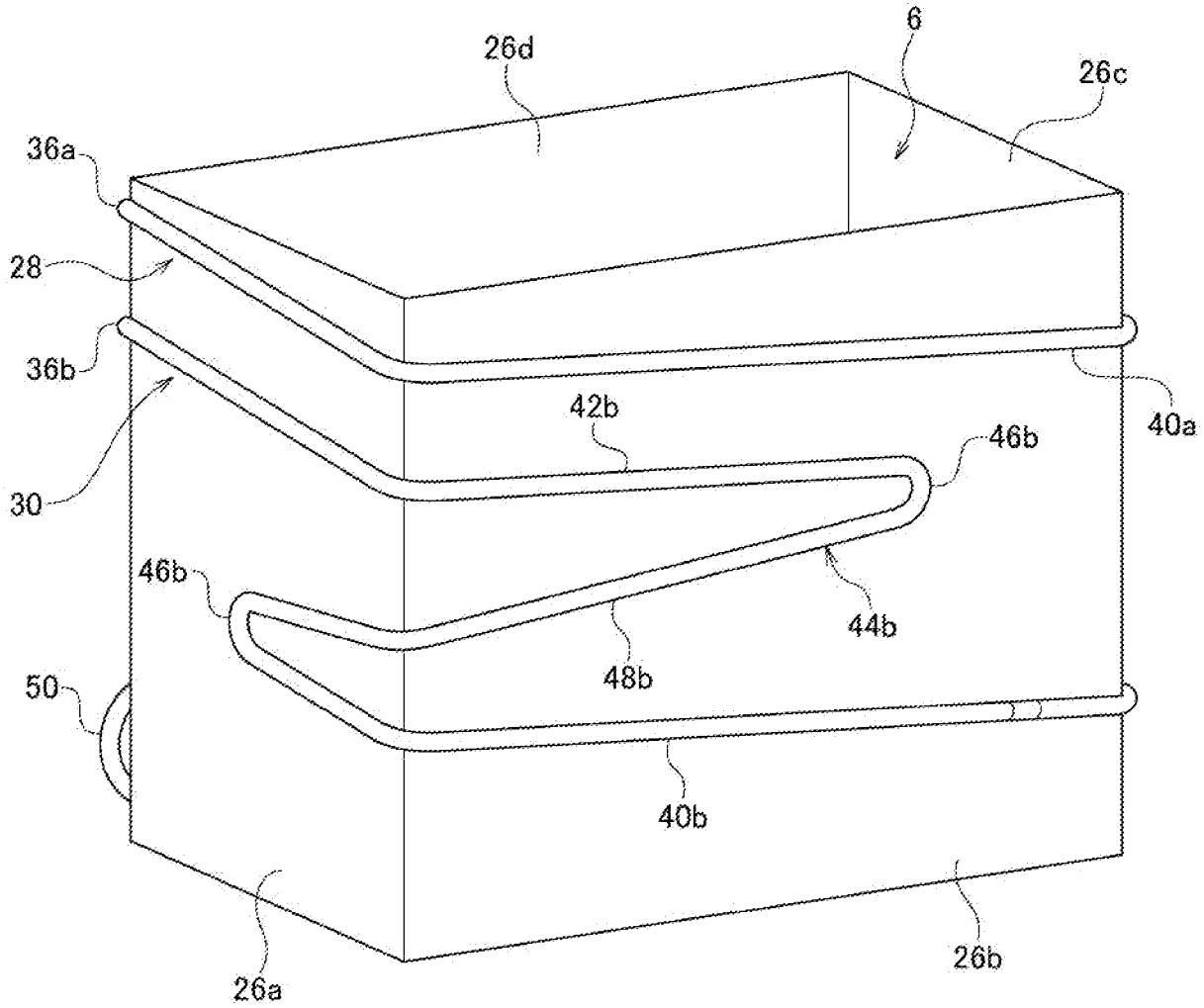
FIG. 3 is a perspective view of a storage chamber and an evaporation unit.
Figure 4:
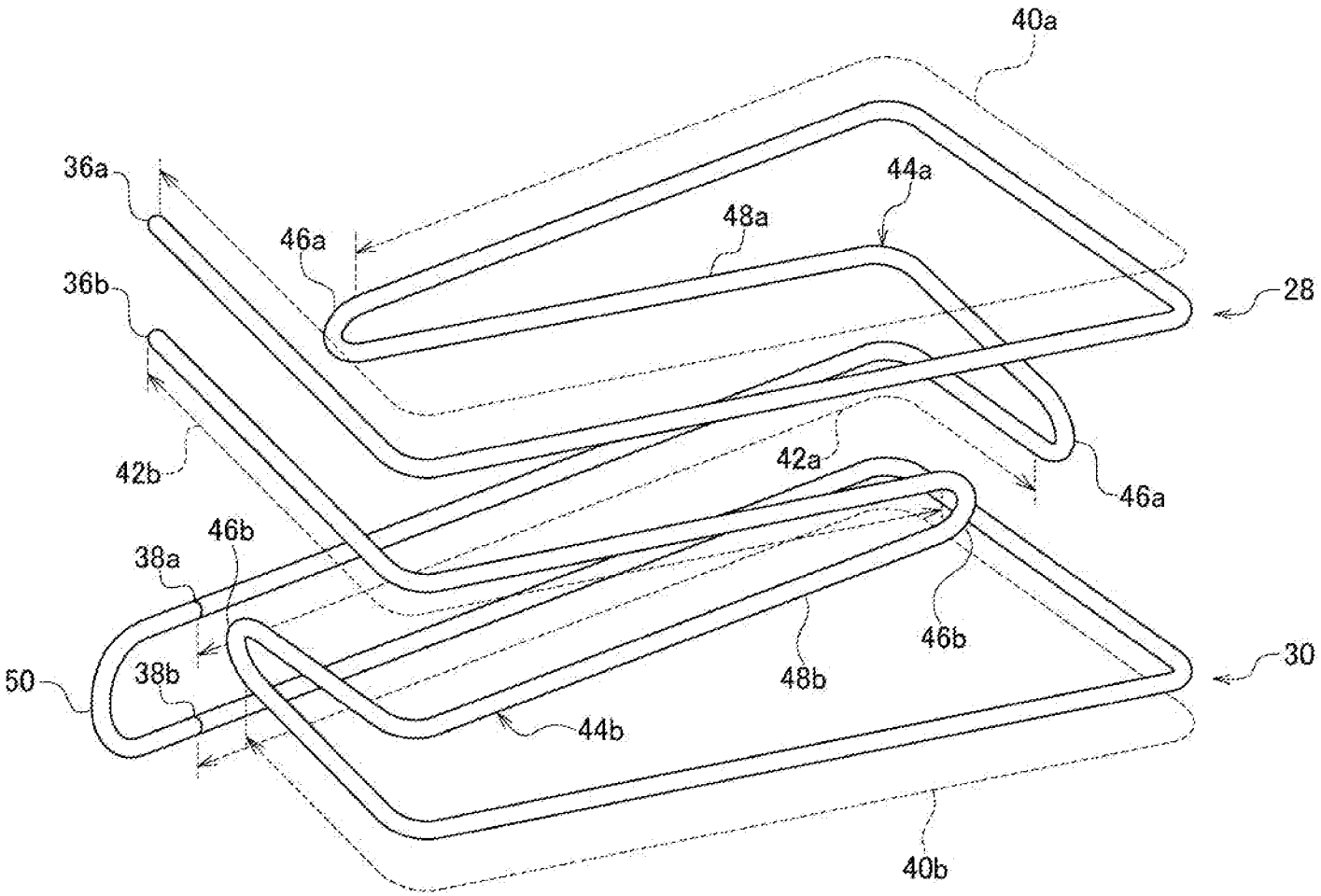
FIG. 4 is a perspective view of the evaporation unit.

In the following, the structure of the evaporation unit 24 will be described in detail. FIG. 3 is a perspective view of the storage chamber and the evaporation unit. FIG. 4 is a perspective view of the evaporation unit. As described previously, the evaporation unit 24 includes the first pipe conduit 28 and the second pipe conduit 30. The first pipe conduit 28 includes: a first near-end part 36*a* located closer to the condensation unit 20; a first far-end part 38*a* located opposite to the first near-end part 36*a*; and a first long circumference part 40*a*, a first short circumference part 42*a*, and a first junction part 44*a* that are arranged between the first near-end part 36*a* and the first far-end part 38*a*.

The second pipe conduit 30 includes: a second near-end part 36*b* located closer to the condensation unit 20; a second far-end part 38*b* located opposite to the second near-end part 36*b*; and a second long circumference part 40*b*, a second short circumference part 42*b*, and a second junction part 44*b* that are arranged between the second near-end part 36*b* and the second far-end part 38*b*.

The first near-end part 36*a* in the first pipe conduit 28 is positioned higher than the second near-end part 36*b*. The first pipe conduit 28 includes the first long circumference part 40*a* located closer to the first near-end part 36*a*, the first short circumference part 42*a* located closer to the first far-end part 38*a*, and the first junction part 44*a* located between the first long circumference part 40*a* and the first short circumference part 42*a*. Accordingly, in the first pipe conduit 28, the first near-end part 36*a*, the first long circumference part 40*a*, the first junction part 44*a*, the first short circumference part 42*a*, and the first far-end part 38*a* are arranged in this order from the condensation unit 20 side.

The first long circumference part 40*a* extends around the storage chamber 6 from the first near-end part 36*a* side toward the first far-end part 38*a* side in a first circumference direction, and also extends along more wall surfaces 26 than the first short circumference part 42*a*. The first junction part 44*a* includes at least one first turning part 46*a* that changes the circumference direction of the first pipe conduit 28. The first short circumference part 42*a* also extends around the storage chamber 6 from the first near-end part 36*a* side toward the first far-end part 38*a* side. The first short circumference part 42*a* extends in the first circumference direction when the number of first turning parts 46*a* is even, and extends in a second circumference direction, which is opposite to the first circumference direction, when the number of first turning parts 46*a* is odd. Also, the first short circumference part 42*a* extends along fewer wall surfaces 26 than the first long circumference part 40*a*.

The second near-end part 36*b* in the second pipe conduit 30 is positioned lower than the first near-end part 36*a*. The second pipe conduit 30 includes the second short circumference part 42*b* located closer to the second near-end part 36*b*, the second long circumference part 40*b* located closer to the second far-end part 38*b*, and the second junction part 44*b* located between the second short circumference part 42*b* and the second long circumference part 40*b*. Accordingly, in the second pipe conduit 30, the second near-end part 36*b*, the second short circumference part 42*b*, the second junction part 44*b*, the second long circumference part 40*b*, and the second far-end part 38*b* are arranged in this order from the condensation unit 20 side.

The second short circumference part 42*b* extends around the storage chamber 6 from the second near-end part 36*b* side toward the second far-end part 38*b* side in the first circumference direction, similarly to the first long circumference part 40*a*. Also, the second short circumference part 42*b* extends along fewer wall surfaces 26 than the second long circumference part 40*b*. The second junction part 44*b* includes a second turning part 46*b* that changes the circumference direction of the second pipe conduit 30 and that is equal in number to the first turning part 46*a*. The second long circumference part 40*b* also extends around the storage chamber 6 from the second near-end part 36*b* side toward the second far-end part 38*b* side. The second long circumference part 40*b* extends in the first circumference direction when the number of second turning parts 46*b* is even, and extends in the second circumference direction when the number of second turning parts 46*b* is odd. Also, the second long circumference part 40*b* extends along more wall surfaces 26 than the second short circumference part 42*b*.

When the number of wall surfaces 26 overlapped by the first long circumference part 40*a* is defined as m, and the number of wall surfaces 26 overlapped by the first short circumference part 42*a* is defined as n, the number m+n of wall surfaces 26 overlapped by the first long circumference part 40*a* or the first short circumference part 42*a* is greater than or equal to the total number of wall surfaces 26 that define the storage chamber 6. The same applies to the second long circumference part 40*b* and the second short circumference part 42*b*. Also, in the present embodiment, the number of wall surfaces 26 overlapped by the first long circumference part 40*a* is equal to that overlapped by the second long circumference part 40*b*, and the number of wall surfaces 26 overlapped by the first short circumference part 42*a* is equal to that overlapped by the second short circumference part 42*b*. The "overlap" means that, when viewed from a normal direction of each wall surface 26, the first pipe conduit 28 or the second pipe conduit 30 overlaps the wall surface 26.

In the present embodiment, the storage chamber 6 includes four wall surfaces 26. The wall surfaces 26 are surfaces extending in a vertical direction. Hereinafter, the four wall surfaces 26 are defined as a first wall surface 26*a*, a second wall surface 26*b*, a third wall surface 26*c*, and a fourth wall surface 26*d*. The first wall surface 26*a* through the fourth wall surface 26*d* are arranged in this order in the counterclockwise direction and define the storage chamber 6. Accordingly, the first wall surface 26*a* and the third wall surface 26*c* face each other, and the second wall surface 26*b* and the fourth wall surface 26*d* face each other. The counterclockwise direction and the clockwise direction in the present embodiment mean the circling directions when the storage chamber 6 is viewed from the upper side in a vertical direction.

The first near-end part 36*a* is disposed to overlap the first wall surface 26*a*. For example, the first near-end part 36*a* is disposed near the side of the first wall surface 26*a* in contact with the fourth wall surface 26*d*. The first long circumference part 40*a* extends around the storage chamber 6 from the first near-end part 36*a* side toward the first far-end part 38*a* side in the counterclockwise direction (first circumference direction), and also extends along the first wall surface 26*a* through the fourth wall surface 26*d*, i.e., four wall surfaces 26.

The number of first turning parts 46*a* is even, and more specifically is two. The first turning part 46*a* positioned first and closer to the first long circumference part 40*a* side is disposed to overlap the fourth wall surface 26*d*, and the first turning part 46*a* positioned second and closer to the first short circumference part 42*a* side is disposed to overlap the third wall surface 26*c*. The first junction part 44*a* includes a first turning pipe conduit 48*a* that connects the two first turning parts 46*a*. The first junction part 44*a* has a pipe shape snaking in a substantial S-shape.

Each first turning part 46*a* has a substantial U-shape, and the first turning part 46*a* positioned first changes the circumference direction of the first pipe conduit 28 from the counterclockwise direction to the clockwise direction (second circumference direction). From the first turning part 46*a* positioned first, the first turning pipe conduit 48*a* extends in the clockwise direction along the fourth wall surface 26*d* and the third wall surface 26*c*, i.e., two wall surfaces 26, to reach the first turning part 46*a* positioned second. The first turning part 46*a* positioned second changes the circumference direction of the first pipe conduit 28 from the clockwise direction to the counterclockwise direction.

The first short circumference part 42*a* extends around the storage chamber 6 from the first near-end part 36*a* side toward the first far-end part 38*a* side in the counterclockwise direction, similarly to the first long circumference part 40*a*, and also extends along the third wall surface 26*c* and the fourth wall surface 26*d*, i.e., two wall surfaces 26. Thus, in the present embodiment, the number of wall surfaces 26 overlapped by the first junction part 44*a* is equal to that overlapped by the first short circumference part 42*a*.

As with the first near-end part 36*a*, the second near-end part 36*b* is also disposed to overlap the first wall surface 26*a*. The second short circumference part 42*b* extends around the storage chamber 6 from the second near-end part 36*b* side toward the second far-end part 38*b* side in the counterclockwise direction, similarly to the first long circumference part 40*a*, and also extends along the first wall surface 26*a* and the second wall surface 26*b*, i.e., two wall surfaces 26. Thus, the number of wall surfaces 26 overlapped by the second short circumference part 42*b* is equal to that overlapped by the first short circumference part 42*a*.

The number of second turning parts 46*b* is even, and more specifically is two. The second turning part 46*b* positioned first and closer to the second short circumference part 42*b* side is disposed to overlap the second wall surface 26*b*, and the second turning part 46*b* positioned second and closer to the second long circumference part 40*b* side is disposed to overlap the first wall surface 26*a*. The second junction part 44*b* includes a second turning pipe conduit 48*b* that connects the two second turning parts 46*b*. The second junction part 44*b* has a pipe shape snaking in a substantial S-shape.

Each second turning part 46*b* has a substantial U-shape, and the second turning part 46*b* positioned first changes the circumference direction of the second pipe conduit 30 from the counterclockwise direction to the clockwise direction. From the second turning part 46*b* positioned first, the second turning pipe conduit 48*b* extends in the clockwise direction along the second wall surface 26*b* and the first wall surface 26*a*, i.e., two wall surfaces 26, to reach the second turning part 46*b* positioned second. The second turning part 46*b* positioned second changes the circumference direction of the second pipe conduit 30 from the clockwise direction to the counterclockwise direction. Thus, in the present embodiment, the number of wall surfaces 26 overlapped by the second junction part 44*b* is equal to that overlapped by the second short circumference part 42*b*.

The second long circumference part 40*b* extends around the storage chamber 6 from the second near-end part 36*b* side toward the second far-end part 38*b* side in the counterclockwise direction, similarly to the first short circumference part 42*a*, and also extends along the first wall surface 26*a* through the fourth wall surface 26*d*, i.e., four wall surfaces 26. Thus, the number of wall surfaces 26 overlapped by the second long circumference part 40*b* is equal to that overlapped by the first long circumference part 40*a*.

The first turning part 46*a* positioned N-th counted from the first near-end part 36*a* side (N is an integer greater than or equal to 1) and the second turning part 46*b* positioned N-th counted from the second near-end part 36*b* side are disposed respectively on wall surfaces 26 facing each other, i.e., wall surfaces 26 extending parallel with each other. These first turning part 46*a* and second turning part 46*b* are disposed at nearly the same height position in a vertical direction. In the present embodiment, the first turning part 46*a* positioned first counted from the first near-end part 36*a* side is disposed on the fourth wall surface 26*d*, and the second turning part 46*b* positioned first counted from the second near-end part 36*b* side is disposed on the second wall surface 26*b* that faces the fourth wall surface 26*d*. These first turning part 46*a* and second turning part 46*b* are disposed at nearly the same height position in a vertical direction. Similarly, the first turning part 46*a* positioned second counted from the first near-end part 36*a* side is disposed on the third wall surface 26*c*, and the second turning part 46*b* positioned second counted from the second near-end part 36*b* side is disposed on the first wall surface 26*a* that faces the third wall surface 26*c*. These first turning part 46*a* and second turning part 46*b* are also disposed at nearly the same height position in a vertical direction.

The heat pipe 16 in the present embodiment is a so-called thermosiphon, which circulates a refrigerant by gravity. Accordingly, the condensation unit 20 is disposed higher than the evaporation unit 24. Also, the first pipe conduit 28 and the second pipe conduit 30 are tilted to extend gradually downward from the near-end parts (36*a*, 36*b*) to the far-end parts (38*a*, 38*b*), respectively. The refrigerant liquefied in the condensation unit 20 is transferred to the evaporation unit 24 by gravity and then flows from the near-end parts (36*a*, 36*b*) toward the far-end parts (38*a*, 38*b*). Accordingly, even when inner surfaces of pipes constituting the heat pipe 16 have simply flat and smooth shapes, such a liquid refrigerant can be transferred to the evaporation unit 24.

The heat pipe 16 in the present embodiment includes the connecting pipe 50 that connects the first far-end part 38*a* and the second far-end part 38*b*. The liquid refrigerant flowing through the first pipe conduit 28 gradually evaporates while flowing from the first near-end part 36*a* toward the first far-end part 38*a*, but the refrigerant partially remains liquid to reach the first far-end part 38*a*. Similarly, the liquid refrigerant flowing through the second pipe conduit 30 also partially remains liquid to reach the second far-end part 38*b*.

Since the first far-end part 38*a* and the second far-end part 38*b* are connected by the connecting pipe 50, the liquid refrigerant that has reached each far-end part can flow into the other pipe conduit side. Accordingly, between the first pipe conduit 28 and the second pipe conduit 30, the liquid refrigerant can be transferred from the pipe conduit in which a larger amount of the liquid refrigerant flows, to the pipe conduit in which a smaller amount of the liquid refrigerant flows. This can equalize the amounts of the liquid refrigerant in the first pipe conduit 28 and the second pipe conduit 30.

Also, the heat pipe 16 in the present embodiment does not include a device that locally changes the refrigerant pressure in the pipe conduits, such as a compressor and an expansion valve, or a structure that changes the refrigerant pressure in the pipe conduits due to pipe blockage by the liquid, such as a narrow tube and a capillary. Accordingly, in the heat pipe 16 of the present embodiment, the refrigerant pressure in the pipe conduits is equal at any portion.

The heat pipe 16 may be structured to include a number of narrow grooves, called wicks, extending in a longitudinal direction of the pipe and provided along the outer circumference inside the pipe, so as to transfer a liquid refrigerant by means of capillary forces exerted between the grooves and the liquid refrigerant. The heat pipe 16 may also be structured to circulate a refrigerant using a device that controls the refrigerant pressure in the pipe conduits, such as a compressor. In this case, the first pipe conduit 28 is used as a forward part, the second pipe conduit 30 is used as a return part, and a circulation passage for the refrigerant is constituted by connecting the compressor, the condensation unit 20, the first pipe 32, the evaporation unit 24, and the second pipe 34 in this order, for example.

More specifically, within the heat pipe 16, the refrigerant is compressed by the compressor and flows, as a high-pressure gas, into the condensation unit 20. The refrigerant within the condensation unit 20 is cooled by the refrigerator 14 to be condensed to liquid and then flows into the first pipe 32. At the time, since the refrigerant within the condensation unit 20 has a high pressure, the refrigerant is condensed to liquid even at a high temperature. Accordingly, the refrigerator 14 can be constituted by a simple device, such as a blower. Therefore, the configuration of the "refrigerator" in the subject application is not particularly limited as long as the refrigerant can be condensed in the condensation unit, and may be a simple device, such as a blower. The liquid refrigerant flowing in the first pipe 32 flows into the first pipe conduit 28 of the evaporation unit 24 through the first pipe 32.

At the time, the refrigerant pressure in the pipe conduit increased by the compressor is reduced in the first pipe 32, so that the heat exchange in the evaporation unit 24 can be efficiently performed. Specifically, the diameter of the first pipe 32 may desirably be locally narrower such that only the refrigerant in the liquid state can flow into the first pipe 32. For example, the first pipe 32 may be constituted by a narrow pipe, such as a capillary. Also, a narrow pipe having a diameter of 2.5 mm or less may be used as the first pipe 32, for example. Accordingly, only the refrigerant in the liquid state can flow into the first pipe 32, so that the refrigerant pressure in the pipe conduit can be efficiently reduced by means of friction within the pipe.

Thereafter, the liquid refrigerant that has flowed into the first pipe conduit 28 of the evaporation unit 24 gradually evaporates as the heat exchange between the evaporation unit 24 and the storage chamber 6 is performed. The refrigerant is then gasified while flowing through the first pipe conduit 28, the connecting pipe 50, and the second pipe conduit 30 and flows into the second pipe 34. The gaseous refrigerant that has flowed into the second pipe 34 then flows into the compressor again to be compressed and flows, as a high-pressure gas, into the condensation unit 20.

Figure 5:
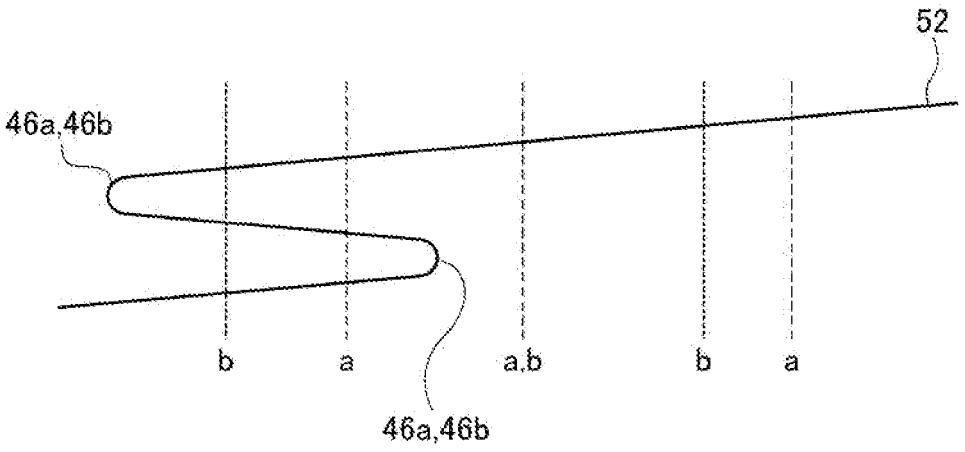
FIG. 5 is a schematic diagram used to describe a method for fabricating a first pipe conduit and a second pipe conduit.

In the present embodiment, the first pipe conduit 28 and the second pipe conduit 30 have the identical entire length. Accordingly, the contact length between the first pipe conduit 28 and the storage chamber 6 can be made equal to the contact length between the second pipe conduit 30 and the storage chamber 6. Therefore, the thermal load applied on each of the first pipe conduit 28 and the second pipe conduit 30 is nearly identical, so that the inside of the storage chamber 6 can be uniformly cooled. Also, the first pipe conduit 28 and the second pipe conduit 30 can be manufactured more easily. FIG. 5 is a schematic diagram used to describe a method for fabricating the first pipe conduit and the second pipe conduit. In FIG. 5, each dotted line a indicates a position at which a pipe material 52 is bent to fabricate the first pipe conduit 28. Also, each dotted line b indicates a position at which the pipe material 52 is bent to fabricate the second pipe conduit 30.

As illustrated in FIG. 5, when the entire length of the first pipe conduit 28 is identical with the entire length of the second pipe conduit 30, each of the first pipe conduit 28 and the second pipe conduit 30 can be manufactured using the pipe material 52 in common. Also, in the first pipe conduit 28 and the second pipe conduit 30 of the present embodiment, the first long circumference part 40*a* and the second long circumference part 40*b* have the identical length, the first short circumference part 42*a* and the second short circumference part 42*b* have the identical length, and the first junction part 44*a* and the second junction part 44*b* have the identical length. Accordingly, the pipe material 52 can be used in common, with the first turning parts 46*a* or the second turning parts 46*b* already formed therein. More specifically, the first pipe conduit 28 and the second pipe conduit 30 can be fabricated using a snaking pipe in common, by making the bending positions (positions at which the pipe is bent to extend along each wall surface 26) thereof different.

Also, in the present embodiment, the number of first turning parts 46*a* and the number of second turning parts 46*b* are both even. Accordingly, bending directions of the snaking pipe can be made identical. More specifically, the pipe material 52 can be bent in the same way at all the dotted lines a or all the dotted lines b, either to form inverted V shapes or V shapes. Also, the angle between the first long circumference part 40*a* and the gravity direction, i.e., the inclination to the gravity direction, is identical with the angle between the second short circumference part 42*b* and the gravity direction. Similarly, the angle between the first short circumference part 42*a* and the gravity direction is identical with the angle between the second long circumference part 40*b* and the gravity direction. Further, the angle between a portion of the first junction part 44*a* winding in the first circumference direction and the gravity direction is identical with the angle between a portion of the second junction part 44*b* winding in the first circumference direction and the gravity direction. The same applies to the portions of the first junction part 44*a* and the second junction part 44*b* winding in the second circumference direction. Accordingly, the first pipe conduit 28 and the second pipe conduit 30 in contact with the storage chamber 6 follow similar trajectories in a vertical direction. Therefore, the storage chamber 6 can be uniformly cooled. Also, all of the portions of the first pipe conduit 28 and the second pipe conduit 30 winding in the first circumference direction and the portions of the first pipe conduit 28 and the second pipe conduit 30 winding in the second circumference direction may be configured such that the angle between each of the portions and the gravity direction becomes identical. This can cool the storage chamber 6 more uniformly.

When the number of wall surfaces 26 of the storage chamber 6 is defined as A, in each of the first pipe conduit 28 and the second pipe conduit 30, the short circumference part (42*a*, 42*b*) extends along wall surfaces 26 of which the number is A/2×B (B is an integer greater than or equal to 1), and the difference between the number of wall surfaces 26 along which the short circumference part (42*a*, 42*b*) extends and the number of wall surfaces 26 along which the long circumference part (40*a*, 40*b*) extends is A/2. In other words, when the number of wall surfaces is defined as A, the number of wall surfaces overlapped by a short circumference part is defined as C, and the number of wall surfaces overlapped by a long circumference part is defined as D, the conditions of C=A/2×B (B is an integer greater than or equal to 1) and D−C=A/2 are satisfied. Accordingly, the total number of pipe portions in the first pipe conduit 28 and the second pipe conduit 30 overlapping each wall surface 26 can be made equal. Consequently, each wall surface 26 is equally cooled, so that the inside of the storage chamber 6 can be cooled more uniformly.

Also, in the present embodiment, the number of wall surfaces 26 along which the first turning pipe conduit 48*a* (or the first junction part 44*a*) extends is equal to the number of wall surfaces 26 along which the second turning pipe conduit 48*b* (or the second junction part 44*b*) extends; when the number of such wall surfaces is defined as E, the condition of E=A/2 is satisfied. Accordingly, all the wall surfaces 26 can be cooled by means of the first turning pipe conduit 48*a* and the second turning pipe conduit 48*b*, so that the inside of the storage chamber 6 can be uniformly cooled.

FIGS. 6A-6F are schematic diagrams that each illustrate a state where the wall surfaces of a storage chamber are developed. In FIGS. 6A-6F, A as the number of wall surfaces 26 is four. Also, the number of first turning parts 46*a* and the number of second turning parts 46*b* are both even in FIGS. 6A-6C and are both odd in FIGS. 6D-6F.

Figure 6A:
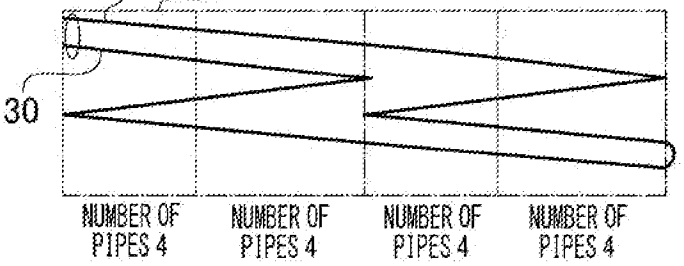
FIGS. 6A, 6B, 6C, 6D, 6E, and 6F are schematic diagrams that each illustrate a state where wall surfaces of a storage chamber are developed.
Figure 6B:
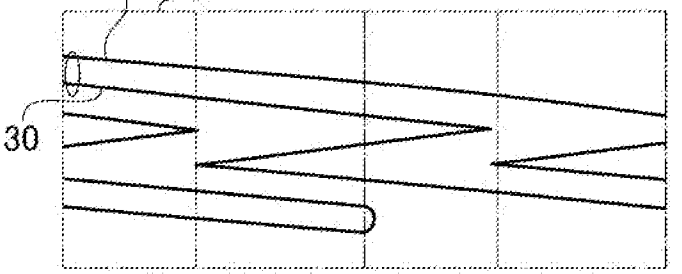
Figure 6C:
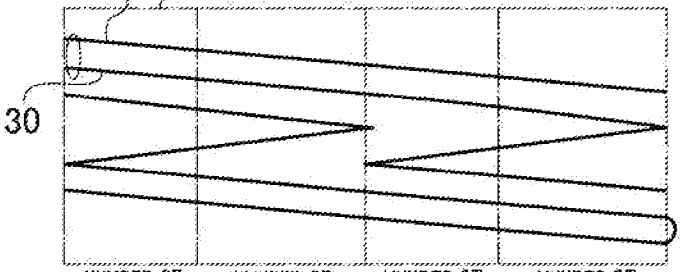
Figure 6D:
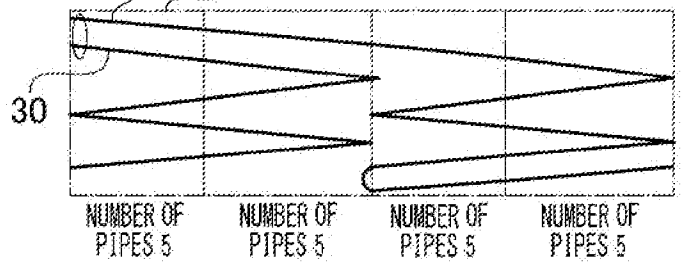

In FIGS. 6A and 6D, each of the first long circumference part 40*a* and the second long circumference part 40*b* overlaps four wall surfaces 26, and each of the first short circumference part 42*a* and the second short circumference part 42*b* overlaps two wall surfaces 26. Accordingly, the number of wall surfaces along which a short circumference part extends is 2, which satisfies the requirement of A/2×B (=4/2×1=2). Also, the difference between the number of wall surfaces along which a long circumference part extends, i.e., 4, and the number of wall surfaces along which a short circumference part extends, i.e., 2, is 2, which satisfies the requirement of A/2 (=4/2=2). In this case, the number of pipe portions overlapping each wall surface 26 becomes equal.

Figure 6E:
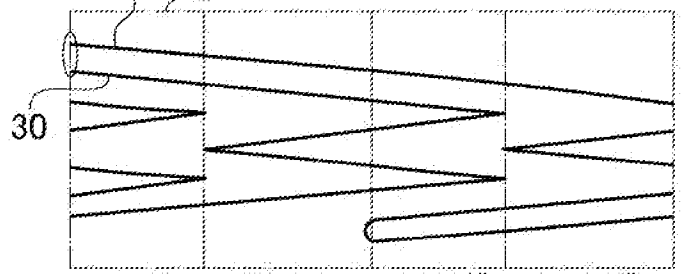

In FIGS. 6B and 6E, each of the first long circumference part 40*a* and the second long circumference part 40*b* overlaps five wall surfaces 26, and each of the first short circumference part 42*a* and the second short circumference part 42*b* overlaps three wall surfaces 26. Accordingly, the number of wall surfaces along which a short circumference part extends is 3, which does not satisfy the requirement of A/2×B (or the requirement of "B is an integer greater than or equal to 1"). Meanwhile, the difference between the number of wall surfaces along which a long circumference part extends, i.e., 5, and the number of wall surfaces along which a short circumference part extends, i.e., 3, is 2, which satisfies the requirement of A/2 (=4/2=2). In this case, the number of pipe portions overlapping each wall surface 26 is not equal.

Figure 6F:
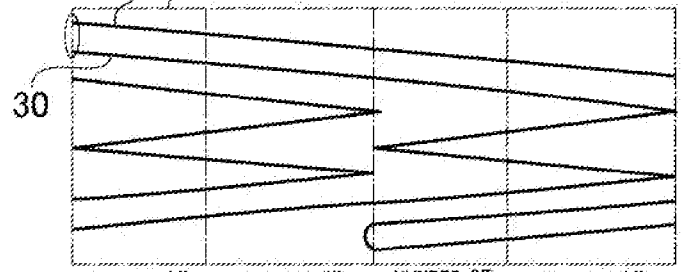

In FIGS. 6C and 6F, each of the first long circumference part 40*a* and the second long circumference part 40*b* overlaps six wall surfaces 26, and each of the first short circumference part 42*a* and the second short circumference part 42*b* overlaps four wall surfaces 26. Accordingly, the number of wall surfaces along which a short circumference part extends is 4, which satisfies the requirement of A/2×B (=4/2×2=4). Also, the difference between the number of wall surfaces along which a long circumference part extends, i.e., 6, and the number of wall surfaces along which a short circumference part extends, i.e., 4, is 2, which satisfies the requirement of A/2 (=4/2=2). In this case, the number of pipe portions overlapping each wall surface 26 becomes equal.

FIGS. 7A-7D are schematic diagrams that each illustrate a state where the wall surfaces of a storage chamber are developed. In FIGS. 7A-7D, A as the number of wall surfaces 26 is six. Also, the number of first turning parts 46*a* and the number of second turning parts 46*b* are both even.

Figure 7A:
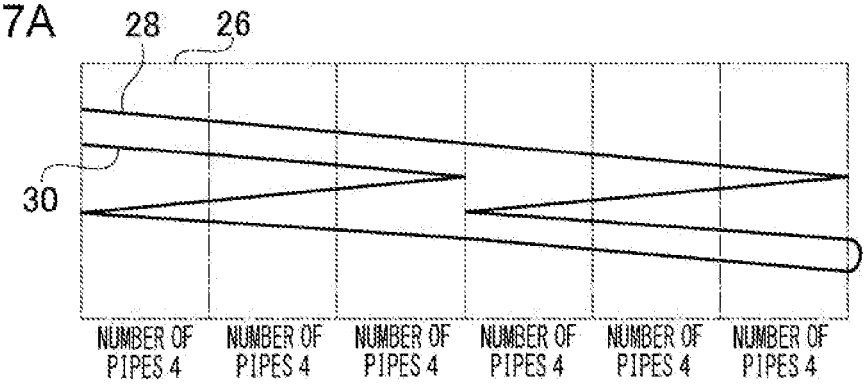
FIGS. 7A, 7B, 7C, and 7D are schematic diagrams that each illustrate a state where the wall surfaces of a storage chamber are developed.

In FIG. 7A, each of the first long circumference part 40*a* and the second long circumference part 40*b* overlaps six wall surfaces 26, and each of the first short circumference part 42*a* and the second short circumference part 42*b* overlaps three wall surfaces 26. Accordingly, the number of wall surfaces along which a short circumference part extends is 3, which satisfies the requirement of A/2×B (=6/2×1=3). Also, the difference between the number of wall surfaces along which a long circumference part extends, i.e., 6, and the number of wall surfaces along which a short circumference part extends, i.e., 3, is 3, which satisfies the requirement of A/2 (=6/2=3). In this case, the number of pipe portions overlapping each wall surface 26 becomes equal.

Figure 7B:
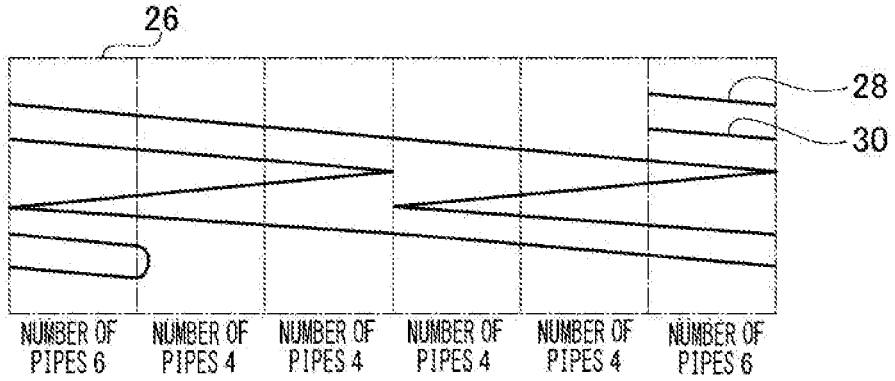

In FIG. 7B, each of the first long circumference part 40*a* and the second long circumference part 40*b* overlaps seven wall surfaces 26, and each of the first short circumference part 42*a* and the second short circumference part 42*b* overlaps four wall surfaces 26. Accordingly, the number of wall surfaces along which a short circumference part extends is 4, which does not satisfy the requirement of A/2×B (or the requirement of "B is an integer greater than or equal to 1"). Meanwhile, the difference between the number of wall surfaces along which a long circumference part extends, i.e., 7, and the number of wall surfaces along which a short circumference part extends, i.e., 4, is 3, which satisfies the requirement of A/2 (=6/2=3). In this case, the number of pipe portions overlapping each wall surface 26 is not equal.

Figure 7C:
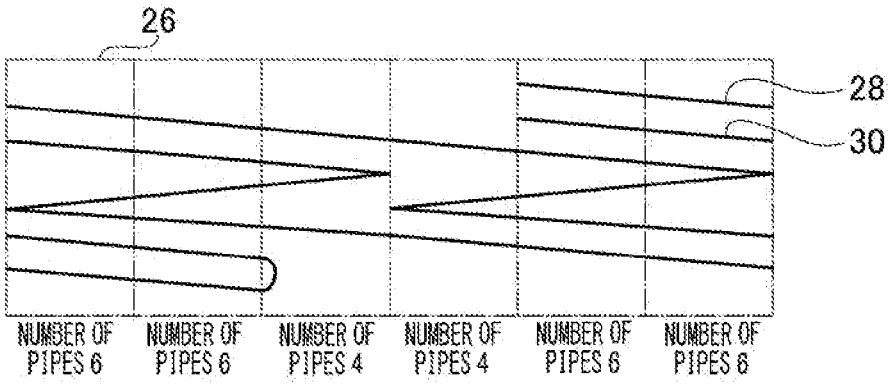

In FIG. 7C, each of the first long circumference part 40*a* and the second long circumference part 40*b* overlaps eight wall surfaces 26, and each of the first short circumference part 42*a* and the second short circumference part 42*b* overlaps five wall surfaces 26. Accordingly, the number of wall surfaces along which a short circumference part extends is 5, which does not satisfy the requirement of A/2×B (or the requirement of "B is an integer greater than or equal to 1"). Meanwhile, the difference between the number of wall surfaces along which a long circumference part extends, i.e., 8, and the number of wall surfaces along which a short circumference part extends, i.e., 5, is 3, which satisfies the requirement of A/2 (=6/2=3). In this case, the number of pipe portions overlapping each wall surface 26 is not equal.

Figure 7D:
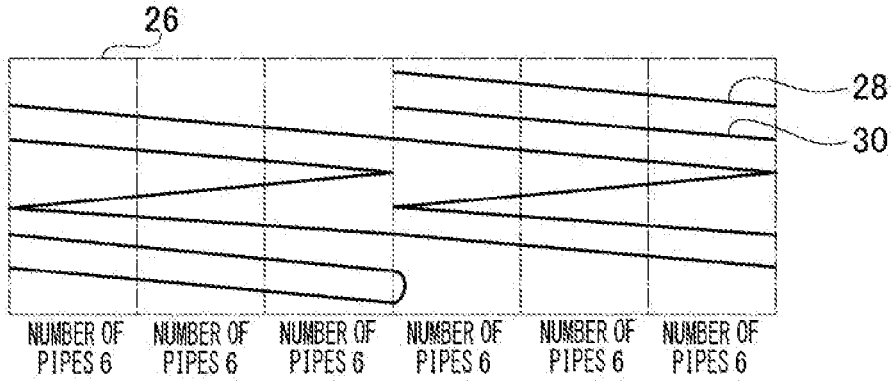

In FIG. 7D, each of the first long circumference part 40*a* and the second long circumference part 40*b* overlaps nine wall surfaces 26, and each of the first short circumference part 42*a* and the second short circumference part 42*b* overlaps six wall surfaces 26. Accordingly, the number of wall surfaces along which a short circumference part extends is 6, which satisfies the requirement of A/2×B (=6/2×2=6). Also, the difference between the number of wall surfaces along which a long circumference part extends, i.e., 9, and the number of wall surfaces along which a short circumference part extends, i.e., 6, is 3, which satisfies the requirement of A/2 (=6/2=3). In this case, the number of pipe portions overlapping each wall surface 26 becomes equal.

FIGS. 8A-8D are schematic diagrams that each illustrate a state where the wall surfaces of a storage chamber are developed. In FIGS. 8A-8D, A as the number of wall surfaces 26 is six. Also, the number of first turning parts 46*a* and the number of second turning parts 46*b* are both odd.

Figure 8A:
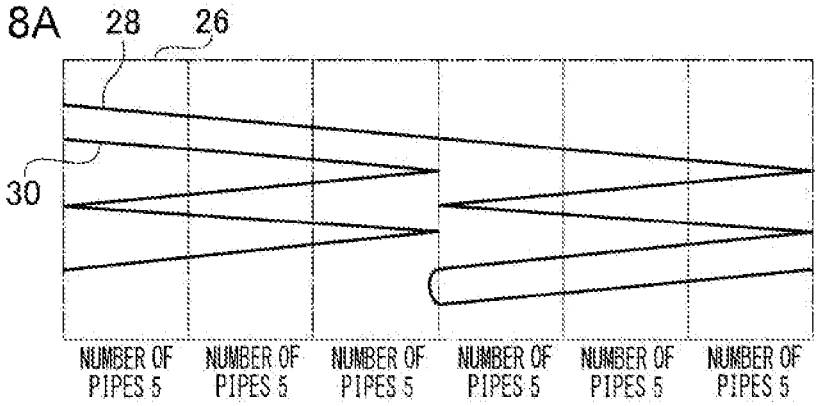
FIGS. 8A, 8B, 8C, and 8D are schematic diagrams that each illustrate a state where the wall surfaces of a storage chamber are developed.

In FIG. 8A, each of the first long circumference part 40*a* and the second long circumference part 40*b* overlaps six wall surfaces 26, and each of the first short circumference part 42*a* and the second short circumference part 42*b* overlaps three wall surfaces 26. Accordingly, the number of wall surfaces along which a short circumference part extends is 3, which satisfies the requirement of A/2×B (=6/2×1=3). Also, the difference between the number of wall surfaces along which a long circumference part extends, i.e., 6, and the number of wall surfaces along which a short circumference part extends, i.e., 3, is 3, which satisfies the requirement of A/2 (=6/2=3). In this case, the number of pipe portions overlapping each wall surface 26 becomes equal.

Figure 8B:
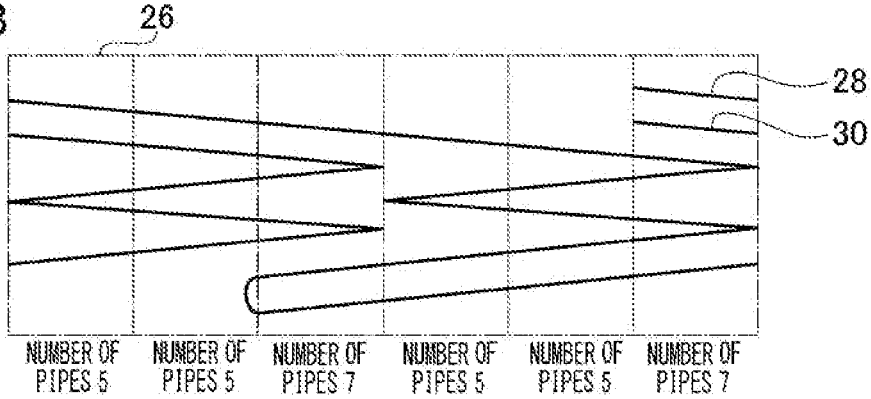

In FIG. 8B, each of the first long circumference part 40*a* and the second long circumference part 40*b* overlaps seven wall surfaces 26, and each of the first short circumference part 42*a* and the second short circumference part 42*b* overlaps four wall surfaces 26. Accordingly, the number of wall surfaces along which a short circumference part extends is 4, which does not satisfy the requirement of A/2×B (or the requirement of "B is an integer greater than or equal to 1"). Meanwhile, the difference between the number of wall surfaces along which a long circumference part extends, i.e., 7, and the number of wall surfaces along which a short circumference part extends, i.e., 4, is 3, which satisfies the requirement of A/2 (=6/2=3). In this case, the number of pipe portions overlapping each wall surface 26 is not equal.

Figure 8C:
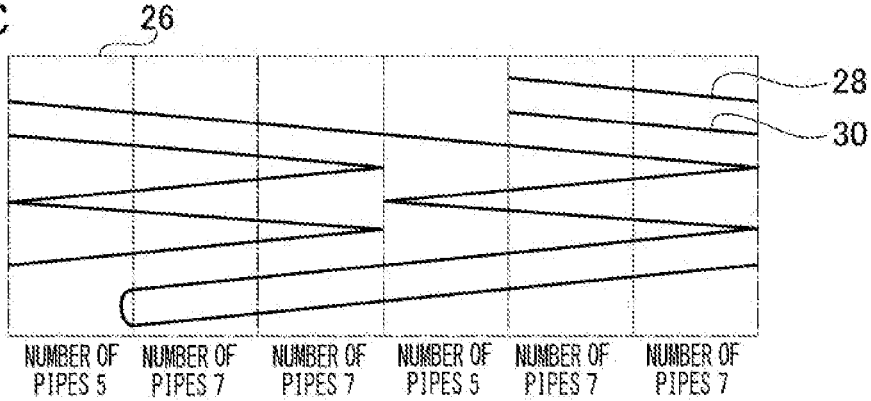

In FIG. 8C, each of the first long circumference part 40*a* and the second long circumference part 40*b* overlaps eight wall surfaces 26, and each of the first short circumference part 42*a* and the second short circumference part 42*b* overlaps five wall surfaces 26. Accordingly, the number of wall surfaces along which a short circumference part extends is 5, which does not satisfy the requirement of A/2×B (or the requirement of "B is an integer greater than or equal to 1"). Meanwhile, the difference between the number of wall surfaces along which a long circumference part extends, i.e., 8, and the number of wall surfaces along which a short circumference part extends, i.e., 5, is 3, which satisfies the requirement of A/2 (=6/2=3). In this case, the number of pipe portions overlapping each wall surface 26 is not equal.

Figure 8D:
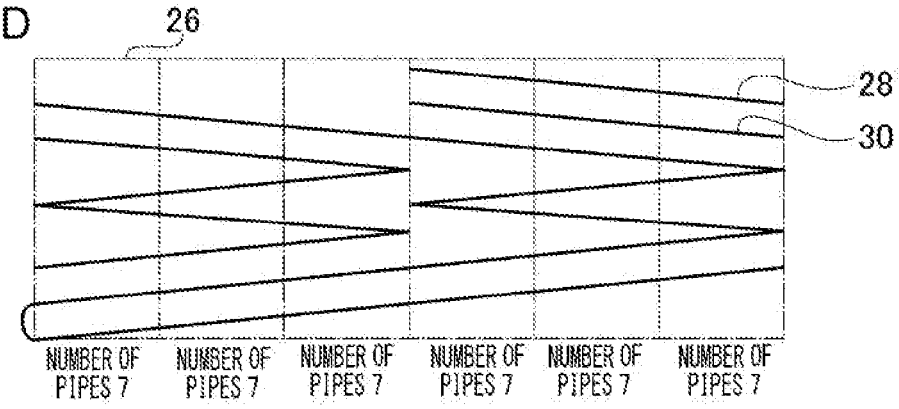

In FIG. 8D, each of the first long circumference part 40*a* and the second long circumference part 40*b* overlaps nine wall surfaces 26, and each of the first short circumference part 42*a* and the second short circumference part 42*b* overlaps six wall surfaces 26. Accordingly, the number of wall surfaces along which a short circumference part extends is 6, which satisfies the requirement of A/2×B (=6/2×2=6). Also, the difference between the number of wall surfaces along which a long circumference part extends, i.e., 9, and the number of wall surfaces along which a short circumference part extends, i.e., 6, is 3, which satisfies the requirement of A/2 (=6/2=3). In this case, the number of pipe portions overlapping each wall surface 26 becomes equal.

As described above, the refrigeration device 12 according to the present embodiment includes: the refrigerator 14; and the heat pipe 16 that includes the condensation unit 20 connected with the refrigerator 14 such that heat exchange therewith can be performed to condense a refrigerant, the evaporation unit 24 that extends along the wall surfaces 26 of the storage chamber 6 housing a preservation object and that is attached to the wall surfaces 26 such that heat exchange therewith can be performed to evaporate the refrigerant, and the pipe unit 22 through which the refrigerant is circulated between the condensation unit 20 and the evaporation unit 24. The evaporation unit 24 includes the first pipe conduit 28 and the second pipe conduit 30.

The first pipe conduit 28 includes: the first near-end part 36*a* located closer to the condensation unit 20; the first far-end part 38*a* located opposite to the first near-end part 36*a*; and the first long circumference part 40*a*, the first short circumference part 42*a*, and the first junction part 44*a* that are arranged between the first near-end part 36*a* and the first far-end part 38*a*. The second pipe conduit 30 includes: the second near-end part 36*b* located closer to the condensation unit 20; the second far-end part 38*b* located opposite to the second near-end part 36*b*; and the second long circumference part 40*b*, the second short circumference part 42*b*, and the second junction part 44*b* that are arranged between the second near-end part 36*b* and the second far-end part 38*b*.

The first near-end part 36*a* in the first pipe conduit 28 is positioned higher than the second near-end part 36*b*, and the first pipe conduit 28 includes the first long circumference part 40*a* located closer to the first near-end part 36*a*, the first short circumference part 42*a* located closer to the first far-end part 38*a*, and the first junction part 44*a* located between the first long circumference part 40*a* and the first short circumference part 42*a*. The first long circumference part 40*a* extends around the storage chamber 6 from the first near-end part 36*a* side toward the first far-end part 38*a* side in the first circumference direction, and also extends along more wall surfaces 26 than the first short circumference part 42*a*. The first junction part 44*a* includes at least one first turning part 46*a* that changes the circumference direction of the first pipe conduit 28. The first short circumference part 42*a* also extends around the storage chamber 6 from the first near-end part 36*a* side toward the first far-end part 38*a* side. The first short circumference part 42*a* extends in the first circumference direction when the number of first turning parts 46*a* is even, and extends in the second circumference direction, which is opposite to the first circumference direction, when the number of first turning parts 46*a* is odd. Also, the first short circumference part 42*a* extends along fewer wall surfaces 26 than the first long circumference part 40*a*.

The second near-end part 36*b* in the second pipe conduit 30 is positioned lower than the first near-end part 36*a*, and the second pipe conduit 30 includes the second short circumference part 42*b* located closer to the second near-end part 36*b*, the second long circumference part 40*b* located closer to the second far-end part 38*b*, and the second junction part 44*b* located between the second short circumference part 42*b* and the second long circumference part 40*b*. The second short circumference part 42*b* extends around the storage chamber 6 from the second near-end part 36*b* side toward the second far-end part 38*b* side in the first circumference direction, and also extends along fewer wall surfaces 26 than the second long circumference part 40*b*. The second junction part 44*b* includes the second turning part 46*b* that changes the circumference direction of the second pipe conduit 30 and that is equal in number to the first turning part 46*a*. The second long circumference part 40*b* also extends around the storage chamber 6 from the second near-end part 36*b* side toward the second far-end part 38*b* side. The second long circumference part 40*b* extends in the first circumference direction when the number of second turning parts 46*b* is even, and extends in the second circumference direction when the number of second turning parts 46*b* is odd. Also, the second long circumference part 40*b* extends along more wall surfaces 26 than the second short circumference part 42*b*.

The first turning part 46*a* positioned N-th counted from the first near-end part 36*a* side (N is an integer greater than or equal to 1) and the second turning part 46*b* positioned N-th counted from the second near-end part 36*b* side are disposed respectively on wall surfaces 26 facing each other. With such a configuration, compared to the case where the entire pipe is wound along the wall surfaces of the storage chamber in the same direction from one end part to the other end part, the number of pipe portions provided on each wall surface can be increased, and vertical intervals between pipe portions can be narrowed. This can make the temperature in the low-temperature storage 1 more stable.

Also, in the present embodiment, the first pipe conduit 28 and the second pipe conduit 30 can be provided, without intersection therebetween, on the wall surfaces 26 of the storage chamber 6. When pipe conduits intersect, one of the pipe conduits is spaced away from the wall surface 26 at the intersection. Accordingly, the efficiency of cooling the storage chamber 6 is reduced by the pipe conduit spaced away at the intersection. In the present embodiment, on the other hand, such reduction in the cooling efficiency can be avoided. Therefore, the storage chamber 6 can be cooled more uniformly, so that the temperature in the low-temperature storage 1 can be made more stable.

In the present embodiment, the first long circumference part 40*a* and the second short circumference part 42*b* as a pair mainly cool an upper area of the storage chamber 6. Also, the first short circumference part 42*a* and the second long circumference part 40*b* as a pair mainly cool a lower area of the storage chamber 6. Further, the first junction part 44*a* and the second junction part 44*b* as a pair mainly cool a middle area of the storage chamber 6. Accordingly, the entirety of the storage chamber 6 can be cooled in a balanced manner.

Also, in the present embodiment, the heat pipe 16 is a thermosiphon, in which each of the first pipe conduit 28 and the second pipe conduit 30 extends gradually downward in a vertical direction from the near-end part to the far-end part. Accordingly, providing the first pipe conduit 28 and the second pipe conduit 30, without intersection therebetween, around the storage chamber 6 can be achieved more easily. Also, the first pipe conduit 28 and the second pipe conduit 30 are connected to the same refrigerator 14. This can simplify the structure of the low-temperature storage 1.

Also, the number of first turning parts 46*a* and the number of second turning parts 46*b* are both even, the first junction part 44*a* includes a first turning pipe conduit 48*a* that connects two adjacent first turning parts 46*a*, and the second junction part 44*b* includes a second turning pipe conduit 48*b* that connects two adjacent second turning parts 46*b*. Accordingly, in each pipe conduit, the long circumference part and the short circumference part can be provided to extend in the same circumference direction.

When the number of wall surfaces 26 of the storage chamber 6 is defined as A, in each of the first pipe conduit 28 and the second pipe conduit 30, the short circumference part extends along wall surfaces 26 of which the number is A/2×B (B is an integer greater than or equal to 1), and the difference between the number of wall surfaces 26 along which the short circumference part extends and the number of wall surfaces 26 along which the long circumference part extends is A/2. Accordingly, the number of pipe portions overlapping each wall surface 26, i.e., the number of times the first pipe conduit 28 and the second pipe conduit 30 pass along each wall surface 26, can be made equal. Consequently, the storage chamber 6 can be cooled more uniformly, so that the temperature in the low-temperature storage 1 can be made more stable.

Also, the first pipe conduit 28 and the second pipe conduit 30 have the identical entire length. Accordingly, each of the first pipe conduit 28 and the second pipe conduit 30 can be fabricated using the pipe material 52 in common. Therefore, the manufacturing cost of the refrigeration device 12 can be reduced. Also, in the first pipe conduit 28 and the second pipe conduit 30, the first long circumference part 40*a* and the second long circumference part 40*b* have the identical length, the first short circumference part 42*a* and the second short circumference part 42*b* have the identical length, and the first junction part 44*a* and the second junction part 44*b* have the identical length. Accordingly, the pipe material 52 can be used in common, with the first turning parts 46*a* or the second turning parts 46*b* already formed therein. Further, the number of first turning parts 46*a* and the number of second turning parts 46*b* are both even. Accordingly, bending directions of the snaking pipe can be made identical. Therefore, the processes for manufacturing the refrigeration device 12 can be further simplified.

The heat pipe 16 includes the connecting pipe 50 that connects the first far-end part 38*a* and the second far-end part 38*b*. This can equalize the amounts of the liquid refrigerant in the first pipe conduit 28 and the second pipe conduit 30. As a result, the storage chamber 6 can be cooled more uniformly, so that the temperature in the low-temperature storage 1 can be made more stable.

Second Embodiment

Figure 9:
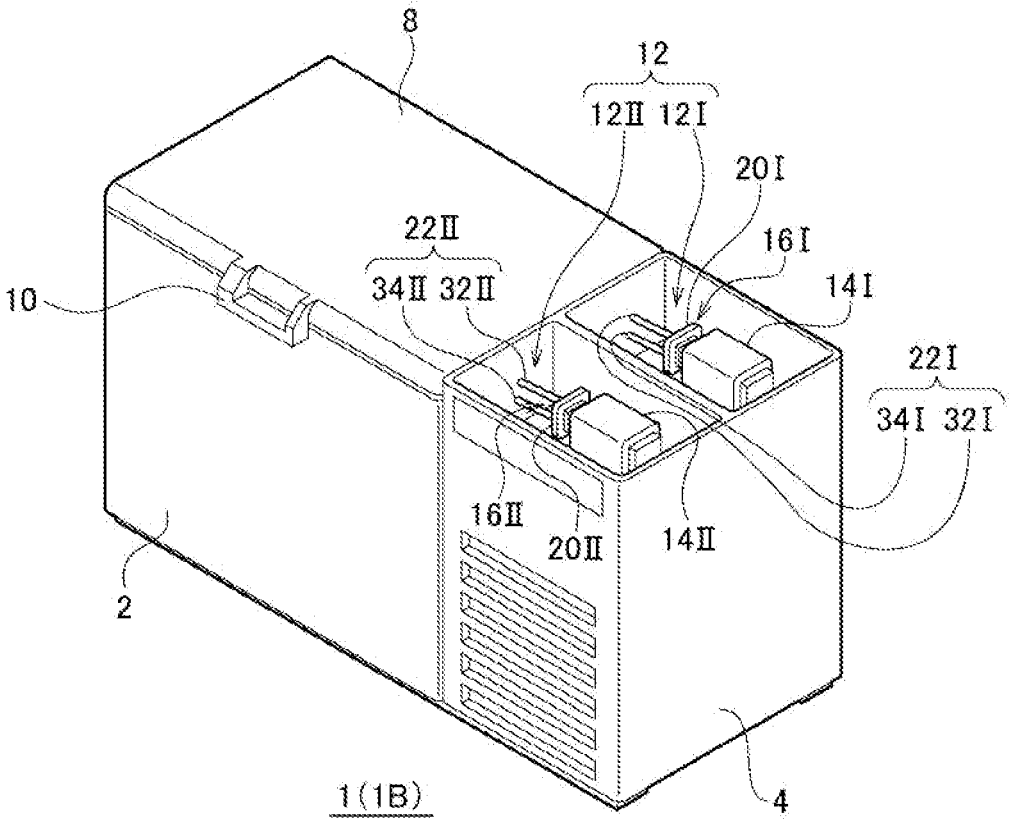
FIG. 9 is a perspective view of a low-temperature storage provided with a refrigeration device according to a second embodiment.
Figure 10A:
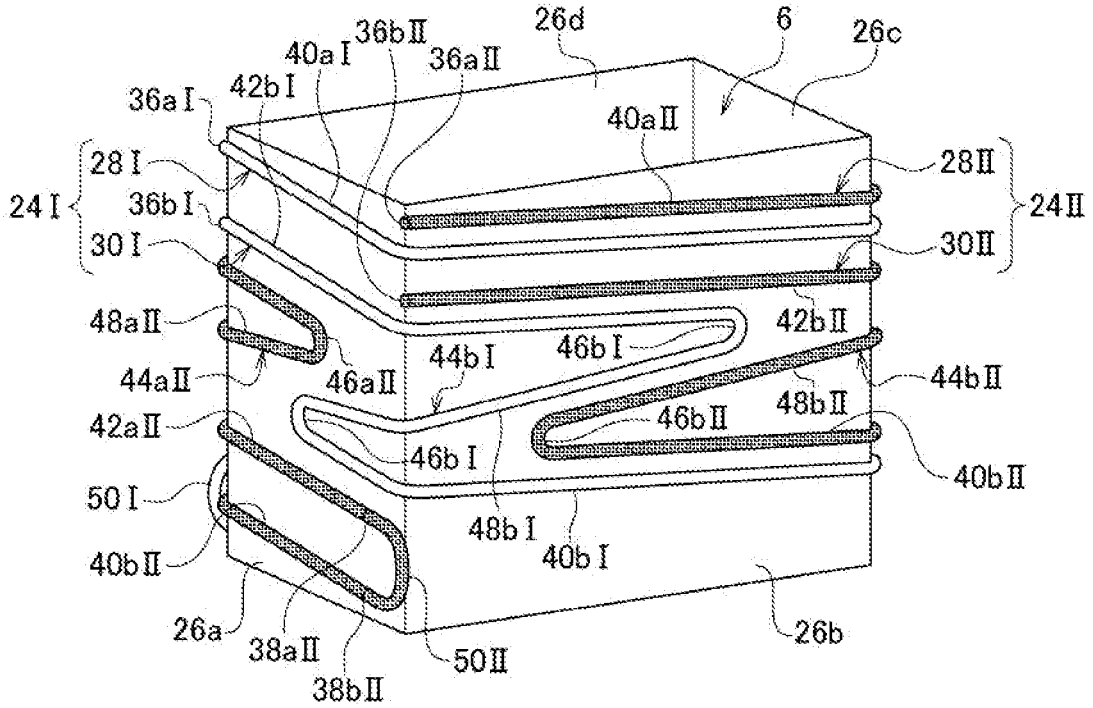
FIG. 10A is a perspective view of a storage chamber and evaporation units.
Figure 10B:
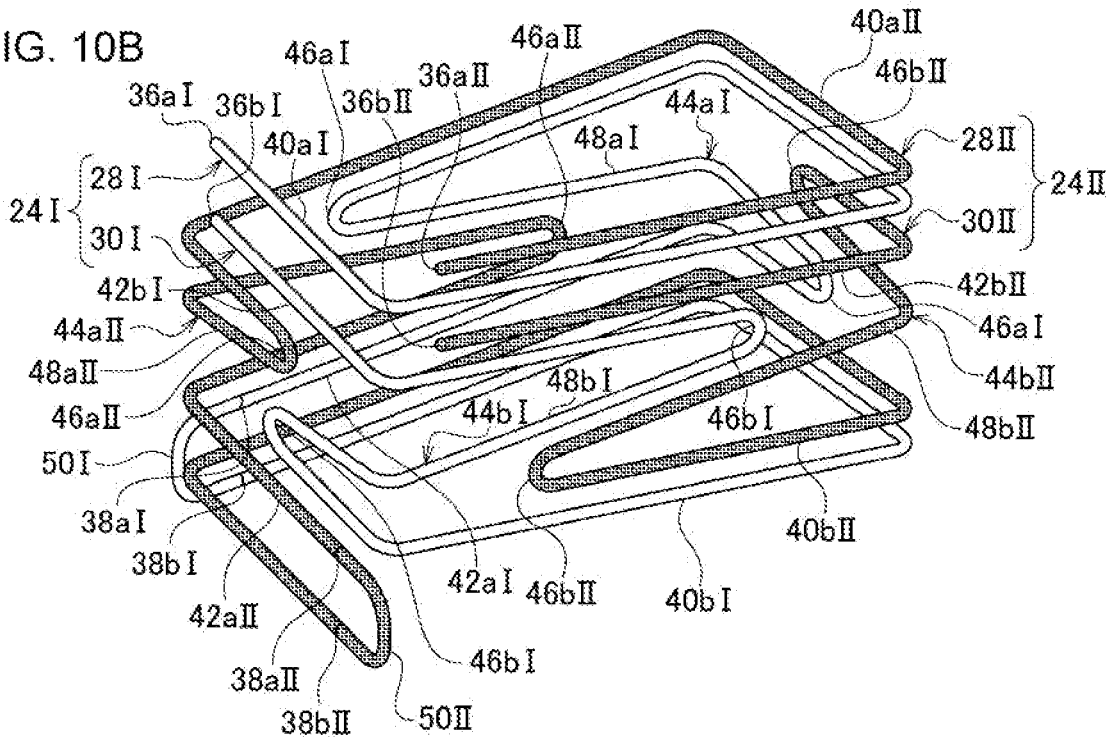
FIG. 10B is a perspective view of the evaporation units.

The second embodiment includes a configuration basically in common with the first embodiment, except that the structure of the refrigeration device 12 is different. In the following, the present embodiment will be described mainly for configurations different from those in the first embodiment, and description of configurations in common will be briefly given or may be omitted. FIG. 9 is a perspective view of a low-temperature storage provided with a refrigeration device according to the second embodiment. FIG. 10A is a perspective view of the storage chamber and evaporation units. FIG. 10B is a perspective view of the evaporation units.

The refrigeration device 12 according to the present embodiment mounted on a low-temperature storage 1 (1B) includes multiple sets of a refrigerator and a heat pipe. As an example, there will be described the refrigeration device 12 that includes a first system 12I as a first set and a second system 12II as a second set. The number of systems is not limited to two. In the following description and drawings, the reference numeral of each configuration included in the first system 12I is provided with "I" at the end, and the reference numeral of each configuration included in the second system 12II is provided with "II" at the end.

The first system 12I includes a first refrigerator 14I and a first heat pipe 16I. The first refrigerator 14I is the refrigerator 14 in the first embodiment, and the first heat pipe 16I is the heat pipe 16 in the first embodiment.

The second system 12II includes a second refrigerator 14II provided separately from the first refrigerator 14I, and a second heat pipe 16II connected to the second refrigerator 14II. The heat pipes (16I, 16II) of the respective systems (12I, 12II) are provided around the same storage chamber 6. In other words, two refrigeration units are provided for one storage chamber 6.

For the second refrigerator 14II, a refrigerator having the same configuration as the first refrigerator 14I may be used. As with the first heat pipe 16I, the second heat pipe 16II includes a condensation unit 20II, a pipe unit 22II, and an evaporation unit 24II. The condensation unit 20II and the pipe unit 22II are configured similarly to the condensation unit 20I and the pipe unit 22I in the first system 12I. The evaporation unit 24II includes a first pipe conduit 28II and a second pipe conduit 30II. The first pipe conduit 28II and the second pipe conduit 30II are connected to the condensation unit 20II, respectively through a first pipe 32II and a second pipe 34II.

The first pipe conduit 28II is structured similarly to the first pipe conduit 28I. More specifically, the first pipe conduit 28II includes: a first near-end part 36*a*II located closer to the condensation unit 20II; a first far-end part 38*a*II located on the opposite side; and a first long circumference part 40*a*II, a first short circumference part 42*a*II, and a first junction part 44*a*II that are arranged between the first near-end part 36*a*II and the first far-end part 38*a*II.

The second pipe conduit 30II is structured similarly to the second pipe conduit 30I. More specifically, the second pipe conduit 30II includes: a second near-end part 36*b*II located closer to the condensation unit 20II; a second far-end part 38*b*II located on the opposite side; and a second long circumference part 40*b*II, a second short circumference part 42*b*II, and a second junction part 44*b*II that are arranged between the second near-end part 36*b*II and the second far-end part 38*b*II.

The first near-end part 36*a*II in the first pipe conduit 28II is positioned higher than the second near-end part 36*b*II. The first pipe conduit 28II includes the first long circumference part 40*a*II located closer to the first near-end part 36*a*II, the first short circumference part 42*a*II located closer to the first far-end part 38*a*II, and the first junction part 44*a*II located between the first long circumference part 40*a*II and the first short circumference part 42*a*II.

The first long circumference part 40*a*II extends around the storage chamber 6 from the first near-end part 36*a*II side toward the first far-end part 38*a*II side in the first circumference direction, and also extends along more wall surfaces 26 than the first short circumference part 42*a*II. The first junction part 44*a*II includes at least one first turning part 46*a*II that changes the circumference direction of the first pipe conduit 28II. The first short circumference part 42*a*II also extends around the storage chamber 6 from the first near-end part 36*a*II side toward the first far-end part 38*a*II side. The first short circumference part 42*a*II extends in the first circumference direction when the number of first turning parts 46*a*II is even, and extends in the second circumference direction, which is opposite to the first circumference direction, when the number of first turning parts 46*a*II is odd. Also, the first short circumference part 42*a*II extends along fewer wall surfaces 26 than the first long circumference part 40*a*II.

The second near-end part 36*b*II in the second pipe conduit 30II is positioned lower than the first near-end part 36*a*II. The second pipe conduit 30II includes the second short circumference part 42*b*II located closer to the second near-end part 36*b*II, the second long circumference part 40*b*II located closer to the second far-end part 38*b*II, and the second junction part 44*b*II located between the second short circumference part 42*b*II and the second long circumference part 40*b*II.

The second short circumference part 42*b*II extends around the storage chamber 6 from the second near-end part 36*b*II side toward the second far-end part 38*b*II side in the first circumference direction, similarly to the first long circumference part 40*a*II. Also, the second short circumference part 42*b*II extends along fewer wall surfaces 26 than the second long circumference part 40*b*II. The second junction part 44*b*II includes a second turning part 46*b*II that changes the circumference direction of the second pipe conduit 30II and that is equal in number to the first turning part 46*a*II. The second long circumference part 40*b*II also extends around the storage chamber 6 from the second near-end part 36*b*II side toward the second far-end part 38*b*II side. The second long circumference part 40*b*II extends in the first circumference direction when the number of second turning parts 46*b*II is even, and extends in the second circumference direction when the number of second turning parts 46*b*II is odd. Also, the second long circumference part 40*b*II extends along more wall surfaces 26 than the second short circumference part 42*b*II.

In the present embodiment, the number of first turning parts 46*a*II in the first pipe conduit 28II is equal to the number of first turning parts 46*a*I in the first pipe conduit 28I. Also, the number of second turning parts 46*b*II in the second pipe conduit 30II is equal to the number of second turning parts 46*b*I in the second pipe conduit 30I. Further, the number of first turning parts 46*a*II in the first pipe conduit 28II is equal to the number of second turning parts 46*b*II in the second pipe conduit 30II, and the number of first turning parts 46*a*I in the first pipe conduit 28I is equal to the number of second turning parts 46*b*I in the second pipe conduit 30I. Thus, the first turning parts 46*a*I, the first turning parts 46*a*II, the second turning parts 46*b*I, and the second turning parts 46*b*II are equal in number. Accordingly, the first system 12I and the second system 12II include the same number of turning parts.

Also, in the present embodiment, the storage chamber 6 around which the first heat pipe 16I and the second heat pipe 16II are provided includes four wall surfaces 26, which are specifically the first wall surface 26*a*, the second wall surface 26*b*, the third wall surface 26*c*, and the fourth wall surface 26*d*. The first wall surface 26*a* through the fourth wall surface 26*d* are arranged in this order in the counterclockwise direction and define the storage chamber 6.

The first pipe conduit 28II and the second pipe conduit 30II have structures obtained by rotating the first pipe conduit 28I and the second pipe conduit 30I in the counterclockwise direction by 90 degrees. Accordingly, the first near-end part 36*a*II is disposed to overlap the second wall surface 26*b*. For example, the first near-end part 36*a*II is disposed near the side of the second wall surface 26*b* in contact with the first wall surface 26*a*. The first long circumference part 40*a*II extends around the storage chamber 6 from the first near-end part 36*a*II side toward the first far-end part 38*a*II side in the counterclockwise direction, and also extends along the second wall surface 26*b* through the first wall surface 26*a*, i.e., four wall surfaces 26.

The number of first turning parts 46*a*II is even, and more specifically is two. The first turning part 46*a*II positioned first and closer to the first long circumference part 40*a*II side is disposed to overlap the first wall surface 26*a*, and the first turning part 46*a*II positioned second and closer to the first short circumference part 42*a*II side is disposed to overlap the fourth wall surface 26*d*. The first junction part 44*a*II includes a first turning pipe conduit 48*a*II that connects the two first turning parts 46*a*II.

Each first turning part 46*a*II has a substantial U-shape, and the first turning part 46*a*II positioned first changes the circumference direction of the first pipe conduit 28II from the counterclockwise direction to the clockwise direction. From the first turning part 46*a*II positioned first, the first turning pipe conduit 48*a*II extends in the clockwise direction along the first wall surface 26*a* and the fourth wall surface 26*d*, i.e., two wall surfaces 26, to reach the first turning part 46*a*II positioned second. The first turning part 46*a*II positioned second changes the circumference direction of the first pipe conduit 28II from the clockwise direction to the counterclockwise direction.

The first short circumference part 42*a*II extends around the storage chamber 6 from the first near-end part 36*a*II side toward the first far-end part 38*a*II side in the counterclockwise direction, similarly to the first long circumference part 40*a*II, and also extends along the fourth wall surface 26*d* and the first wall surface 26*a*, i.e., two wall surfaces 26.

As with the first near-end part 36*a*II, the second near-end part 36*b*II is also disposed to overlap the second wall surface 26*b*. The second short circumference part 42*b*II extends around the storage chamber 6 from the second near-end part 36*b*II side toward the second far-end part 38*b*II side in the counterclockwise direction, similarly to the first long circumference part 40*a*II, and also extends along the second wall surface 26*b* and the third wall surface 26*c*, i.e., two wall surfaces 26.

The number of second turning parts 46*b*II is even, and more specifically is two. The second turning part 46*b*II positioned first and closer to the second short circumference part 42*b*II side is disposed to overlap the third wall surface 26*c*, and the second turning part 46*b*II positioned second and closer to the second long circumference part 40*b*II side is disposed to overlap the second wall surface 26*b*. The second junction part 44*b*II includes a second turning pipe conduit 48*b*II that connects the two second turning parts 46*b*II.

Each second turning part 46*b*II has a substantial U-shape, and the second turning part 46*b*II positioned first changes the circumference direction of the second pipe conduit 30II from the counterclockwise direction to the clockwise direction. From the second turning part 46*b*II positioned first, the second turning pipe conduit 48*b*II extends in the clockwise direction along the third wall surface 26*c* and the second wall surface 26*b*, i.e., two wall surfaces 26, to reach the second turning part 46*b*II positioned second. The second turning part 46*b*II positioned second changes the circumference direction of the second pipe conduit 30II from the clockwise direction to the counterclockwise direction.

The second long circumference part 40*b*II extends around the storage chamber 6 from the second near-end part 36*b*II side toward the second far-end part 38*b*II side in the counterclockwise direction, similarly to the first short circumference part 42*a*II, and also extends along the second wall surface 26*b* through the first wall surface 26*a*, i.e., four wall surfaces 26.

The first turning part 46*a*II positioned N-th counted from the first near-end part 36*a*II side (N is an integer greater than or equal to 1) and the second turning part 46*b*II positioned N-th counted from the second near-end part 36*b*II side are disposed respectively on wall surfaces 26 facing each other. In the present embodiment, the first turning part 46*a*II positioned first counted from the first near-end part 36*a*II side is disposed on the first wall surface 26*a*, and the second turning part 46*b*II positioned first counted from the second near-end part 36*b*II side is disposed on the third wall surface 26*c* that faces the first wall surface 26*a*. Similarly, the first turning part 46*a*II positioned second counted from the first near-end part 36*a*II side is disposed on the fourth wall surface 26*d*, and the second turning part 46*b*II positioned second counted from the second near-end part 36*b*II side is disposed on the second wall surface 26*b* that faces the fourth wall surface 26*d*.

Further, in the present embodiment, the first turning part 46*a*I and the second turning part 46*b*I positioned N-th counted from the condensation unit 20I side of the first heat pipe 16I (N is an integer greater than or equal to 1) and the first turning part 46*a*II and the second turning part 46*b*II positioned N-th counted from the condensation unit 20II side of the second heat pipe 16II are each disposed on a different wall surface.

In the present embodiment, the first turning part 46*a*I and the second turning part 46*b*I positioned first counted from the condensation unit 20I side of the first heat pipe 16I are disposed respectively on the fourth wall surface 26*d* and the second wall surface 26*b*. Meanwhile, the first turning part 46*a*II and the second turning part 46*b*II positioned first counted from the condensation unit 20II side of the second heat pipe 16II are disposed respectively on the first wall surface 26*a* and the third wall surface 26*c*. Thus, these four turning parts are disposed on different wall surfaces 26.

Also, the first turning part 46*a*I and the second turning part 46*b*I positioned second counted from the condensation unit 20I side of the first heat pipe 16I are disposed respectively on the third wall surface 26*c* and the first wall surface 26*a*. Meanwhile, the first turning part 46*a*II and the second turning part 46*b*II positioned second counted from the condensation unit 20II side of the second heat pipe 16II are disposed respectively on the fourth wall surface 26*d* and the second wall surface 26*b*. Thus, these four turning parts are disposed on different wall surfaces 26.

As with the first heat pipe 16I, the second heat pipe 16II is also a thermosiphon. Accordingly, the first pipe conduit 28II and the second pipe conduit 30II are tilted to extend gradually downward in a vertical direction from the near-end parts (36*a*II, 36*b*II) to the far-end parts (38*a*II, 38*b*II), respectively. The second heat pipe 16II includes a connecting pipe 50II that connects the first far-end part 38*a*II and the second far-end part 38*b*II. The second heat pipe 16II may also be structured to circulate a refrigerant using a compressor or the like.

A connecting pipe 50I has a substantial U-shape, and, when viewed from a normal direction of the fourth wall surface 26*d*, the curved portion protrudes from the fourth wall surface 26*d*. More specifically, when viewed from a normal direction of the fourth wall surface 26*d*, the curved portion of the connecting pipe 50I protrudes in a normal direction of the first wall surface 26*a* from the side of the fourth wall surface 26*d* in contact with the first wall surface 26*a*. Accordingly, the connecting pipe 50I includes an area not in contact with the fourth wall surface 26*d*. Meanwhile, the second long circumference part 40*b*II extends from the fourth wall surface 26*d* to the first wall surface 26*a* such as to be positioned within the portion of the connecting pipe 50I protruding from the fourth wall surface 26*d*. In other words, the portion of the connecting pipe 50I protruding from the fourth wall surface 26*d* is provided across the second long circumference part 40*b*II. Accordingly, the first heat pipe 16I and the second heat pipe 16II can be provided around the same storage chamber 6, with minimized intersections among the pipe conduits. More specifically, the first pipe conduit 28I, the first pipe conduit 28II, the second pipe conduit 30I, and the second pipe conduit 30II do not intersect each other, so that the entirety of each pipe conduit is in contact with wall surfaces 26. Only the connecting pipe 50I is spaced away from the wall surfaces 26. Accordingly, the storage chamber 6 can be cooled more uniformly, so that the temperature in the low-temperature storage 1 can be made more stable. In a configuration not provided with the connecting pipe 50I, the first heat pipe 16I and the second heat pipe 16II can be provided, without intersection therebetween, around the same storage chamber 6 and also without structural ingenuity, such as a pipe partially protruding from a wall surface.

Figure 11:
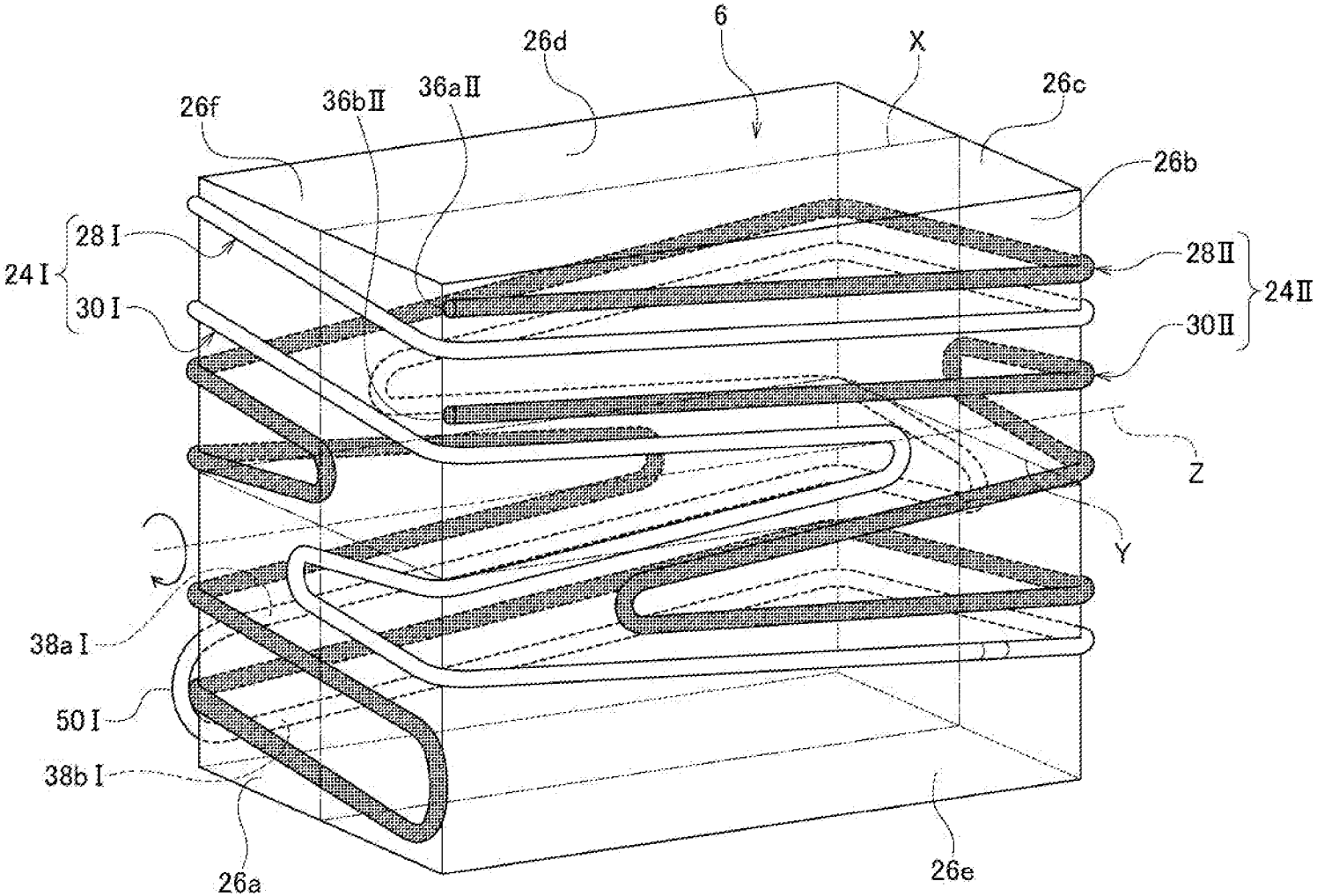
FIG. 11 is a schematic diagram used to describe a postural relationship between the evaporation unit of a first heat pipe and the evaporation unit of a second heat pipe.

Also, in the present embodiment, the first pipe conduit 28II and the second pipe conduit 30II in the second heat pipe 16II have shapes obtained by turning upside down the first pipe conduit 28I and the second pipe conduit 30I in the first heat pipe 16I. FIG. 11 is a schematic diagram used to describe a postural relationship between the evaporation unit of the first heat pipe and the evaporation unit of the second heat pipe. As illustrated in FIG. 11, the first pipe conduit 28II and the second pipe conduit 30II have shapes identical with those obtained by rotating the first pipe conduit 28I and the second pipe conduit 30I about an axis Z as the rotational axis by 180 degrees. The axis Z is the line of intersection between a virtual plane X, which is parallel to the second wall surface 26*b* and the fourth wall surface 26*d* facing each other and is positioned in the middle between the two wall surfaces, and a virtual plane Y, which is parallel to a bottom surface 26*e* (the lower surface) and a top surface 26*f* (the upper surface) of the storage chamber 6 and is positioned in the middle between the two surfaces. The top surface 26*f* is a plane that includes the upper ends of the first wall surface 26*a* through the fourth wall surface 26*d*.

The first near-end part 36*a*II of the first pipe conduit 28II corresponds to the second far-end part 38*b*I of the second pipe conduit 30I. Also, the second near-end part 36*b*II of the second pipe conduit 30II corresponds to the first far-end part 38*a*I of the first pipe conduit 28I. When the first pipe conduit 28I and the second pipe conduit 30I are turned upside down and when the connecting pipe 50I connected to the first far-end part 38*a*I and the second far-end part 38*b*I is connected to the first near-end part 36*a*I and the second near-end part 36*b*I instead, the evaporation unit 24II can be obtained. Accordingly, the evaporation unit 24I and the evaporation unit 24II can be configured using identically shaped components. Therefore, each of the evaporation unit 24I and the evaporation unit 24II can equally exchange the heat with the storage chamber 6. More specifically, in both the cases where each of the first system 12I and the second system 12II is solely driven and where both the first system 12I and the second system 12II are simultaneously driven, the storage chamber 6 can be cooled more uniformly.

Also, as with the first pipe conduit 28I and the second pipe conduit 30I, the first pipe conduit 28II and the second pipe conduit 30II have the identical entire length. Accordingly, each of the first pipe conduit 28II and the second pipe conduit 30II can be manufactured using the pipe material 52 in common. Further, in the first pipe conduit 28II and the second pipe conduit 30II, the first long circumference part 40*a*II and the second long circumference part 40*b*II have the identical length, the first short circumference part 42*a*II and the second short circumference part 42*b*II have the identical length, and the first junction part 44*a*II and the second junction part 44*b*II have the identical length. Accordingly, the pipe material 52 can be used in common, with the first turning parts 46*a*II or the second turning parts 46*b*II already formed therein. Also, the number of first turning parts 46*a*II and the number of second turning parts 46*b*II are both even. Accordingly, bending directions of the snaking pipe can be made identical.

Also, when the number of wall surfaces of the storage chamber 6 is defined as A, the number of wall surfaces overlapped by a short circumference part is defined as C, and the number of wall surfaces overlapped by a long circumference part is defined as D, the first pipe conduit 28I and the second pipe conduit 30I, and the first pipe conduit 28II and the second pipe conduit 30II satisfy the conditions of $C=A/2\times B$ (B is an integer greater than or equal to 1) and $D-C=A/2$. Accordingly, the number of pipe portions overlapping each wall surface 26 can be made equal in each of the first system 12I and the second system 12II. Also in the first system 12I and the second system 12II as a whole, the number of pipe portions overlapping each wall surface 26 can be made equal. Therefore, in both the cases where each of the first system 12I and the second system 12II is solely driven and where both the first system 12I and the second system 12II are simultaneously driven, the storage chamber 6 can be cooled more uniformly.

FIGS. 12A-12F are schematic diagrams that each illustrate a state where the wall surfaces of a storage chamber are developed. In FIGS. 12A-12F, the first pipe conduit 28I and the second pipe conduit 30I in the first system 12I are indicated by solid lines, and the first pipe conduit 28II and the second pipe conduit 30II in the second system 12II are indicated by dotted lines. In FIGS. 12A-12F, A as the number of wall surfaces 26 is four. Also, the number of each of the turning parts (46*a*I, 46*b*I, 46*a*II, 46*b*II) is even in FIGS. 12A-12C and is odd in FIGS. 12D-12F.

In FIGS. 12A and 12D, in both the first system 12I and the second system 12II, each of the long circumference parts (40*a*I, 40*b*I, 40*a*II, 40*b*II) overlaps four wall surfaces 26, and each of the short circumference parts (42*a*I, 42*b*I, 42*a*II, 42*b*II) overlaps two wall surfaces 26. Accordingly, the number of wall surfaces along which a short circumference part extends is 2, which satisfies the requirement of $A/2\times B$ ($=4/2\times 1=2$). Also, the difference between the number of wall surfaces along which a long circumference part extends, i.e., 4, and the number of wall surfaces along which a short circumference part extends, i.e., 2, is 2, which satisfies the requirement of $A/2$ ($=4/2=2$). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

In FIGS. 12B and 12E, in both the first system 12I and the second system 12II, each of the long circumference parts (40*a*I, 40*b*I, 40*a*II, 40*b*II) overlaps five wall surfaces 26, and each of the short circumference parts (42*a*I, 42*b*I, 42*a*II, 42*b*II) overlaps three wall surfaces 26. Accordingly, the number of wall surfaces along which a short circumference part extends is 3, which does not satisfy the requirement of $A/2\times B$ (or the requirement of "B is an integer greater than or equal to 1"). Meanwhile, the difference between the number of wall surfaces along which a long circumference part extends, i.e., 5, and the number of wall surfaces along which a short circumference part extends, i.e., 3, is 2, which satisfies the requirement of $A/2$ ($=4/2=2$). In this case, the number of pipe portions overlapping each wall surface 26 is not equal in each of the first system 12I and the second system 12II.

Also, as illustrated in FIG. 12B, when the number of each of the turning parts (46*a*I, 46*b*I, 46*a*II, 46*b*II) is even, the number of pipe portions overlapping each wall surface 26 is not equal also in the first system 12I and the second system 12II as a whole. On the other hand, as illustrated in FIG. 12E, when the number of each of the turning parts (46*a*I, 46*b*I, 46*a*II, 46*b*II) is odd, the number of pipe portions overlapping each wall surface 26 becomes equal in the first system 12I and the second system 12II as a whole. Accordingly, when the number of each of the turning parts is odd, the storage chamber 6 can be uniformly cooled when the first system 12I and the second system 12II are simultaneously driven. However, when only one of the systems is solely driven, the cooling uniformity is reduced.

In FIGS. 12C and 12F, in both the first system 12I and the second system 12II, each of the long circumference parts (40*a*I, 40*b*I, 40*a*II, 40*b*II) overlaps six wall surfaces 26, and each of the short circumference parts (42*a*I, 42*b*I, 42*a*II, 42*b*II) overlaps four wall surfaces 26. Accordingly, the number of wall surfaces along which a short circumference part extends is 4, which satisfies the requirement of $A/2\times B$ ($=4/2\times 2=4$). Also, the difference between the number of wall surfaces along which a long circumference part extends, i.e., 6, and the number of wall surfaces along which a short circumference part extends, i.e., 4, is 2, which satisfies the requirement of $A/2$ ($=4/2=2$). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

FIGS. 13A-13D are schematic diagrams that each illustrate a state where the wall surfaces of a storage chamber are developed. In FIGS. 13A-13D, the first pipe conduit 28I and the second pipe conduit 30I in the first system 12I are indicated by solid lines, and the first pipe conduit 28II and the second pipe conduit 30II in the second system 12II are indicated by dotted lines. In FIGS. 13A-13D, A as the number of wall surfaces 26 is six. Also, the number of each of the turning parts (46*a*I, 46*b*I, 46*a*II, 46*b*II) is even.

Figure 13A:
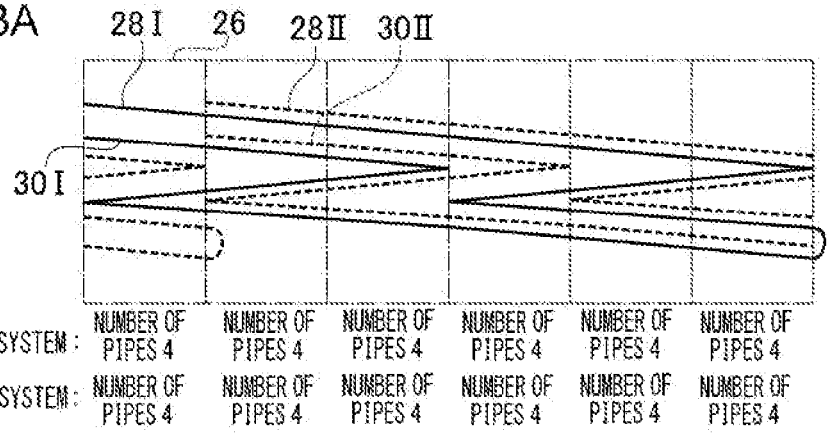
FIGS. 13A, 13B, 13C, and 13D are schematic diagrams that each illustrate a state where the wall surfaces of a storage chamber are developed.

In FIG. 13A, each of the long circumference parts (40*a*I, 40*b*I, 40*a*II, 40*b*II) overlaps six wall surfaces 26, and each of the short circumference parts (42*a*I, 42*b*I, 42*a*II, 42*b*II) overlaps three wall surfaces 26. Accordingly, the number of wall surfaces along which a short circumference part extends is 3, which satisfies the requirement of A/2×B (=6/2×1=3). Also, the difference between the number of wall surfaces along which a long circumference part extends, i.e., 6, and the number of wall surfaces along which a short circumference part extends, i.e., 3, is 3, which satisfies the requirement of A/2 (=6/2=3). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

Figure 13B:
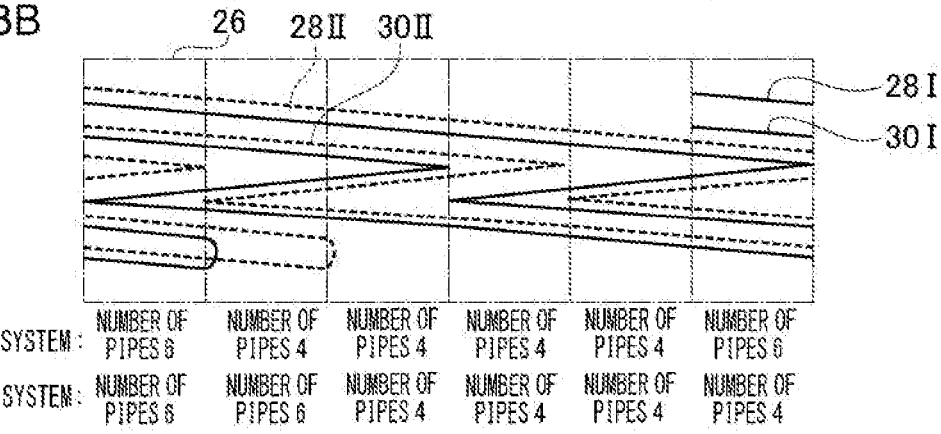

In FIG. 13B, each of the long circumference parts (40*a*I, 40*b*I, 40*a*II, 40*b*II) overlaps seven wall surfaces 26, and each of the short circumference parts (42*a*I, 42*b*I, 42*a*II, 42*b*II) overlaps four wall surfaces 26. Accordingly, the number of wall surfaces along which a short circumference part extends is 4, which does not satisfy the requirement of A/2×B (or the requirement of "B is an integer greater than or equal to 1"). Meanwhile, the difference between the number of wall surfaces along which a long circumference part extends, i.e., 7, and the number of wall surfaces along which a short circumference part extends, i.e., 4, is 3, which satisfies the requirement of A/2 (=6/2=3). In this case, the number of pipe portions overlapping each wall surface 26 is not equal in each of the first system 12I and the second system 12II. Also in the first system 12I and the second system 12II as a whole, the number of pipe portions overlapping each wall surface 26 is not equal.

Figure 13C:
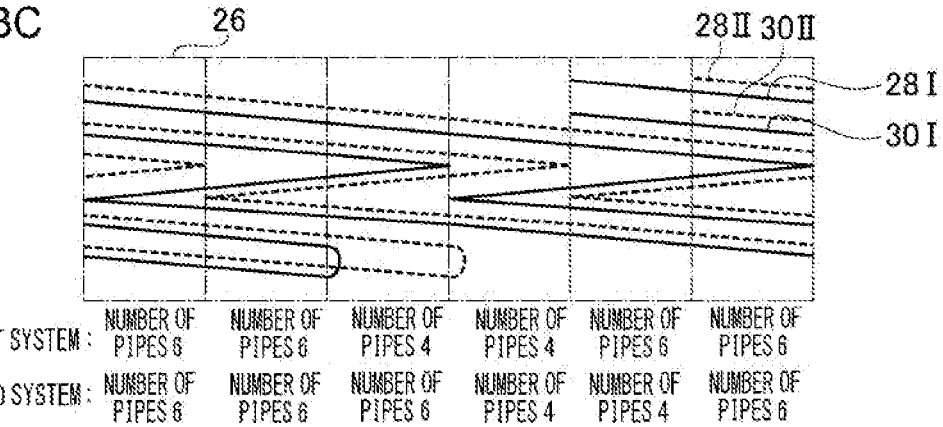

In FIG. 13C, each of the long circumference parts (40*a*I, 40*b*I, 40*a*II, 40*b*II) overlaps eight wall surfaces 26, and each of the short circumference parts (42*a*I, 42*b*I, 42*a*II, 42*b*II) overlaps five wall surfaces 26. Accordingly, the number of wall surfaces along which a short circumference part extends is 5, which does not satisfy the requirement of A/2×B (or the requirement of "B is an integer greater than or equal to 1"). Meanwhile, the difference between the number of wall surfaces along which a long circumference part extends, i.e., 8, and the number of wall surfaces along which a short circumference part extends, i.e., 5, is 3, which satisfies the requirement of A/2 (=6/2=3). In this case, the number of pipe portions overlapping each wall surface 26 is not equal in each of the first system 12I and the second system 12II. Also in the first system 12I and the second system 12II as a whole, the number of pipe portions overlapping each wall surface 26 is not equal.

Figure 13D:
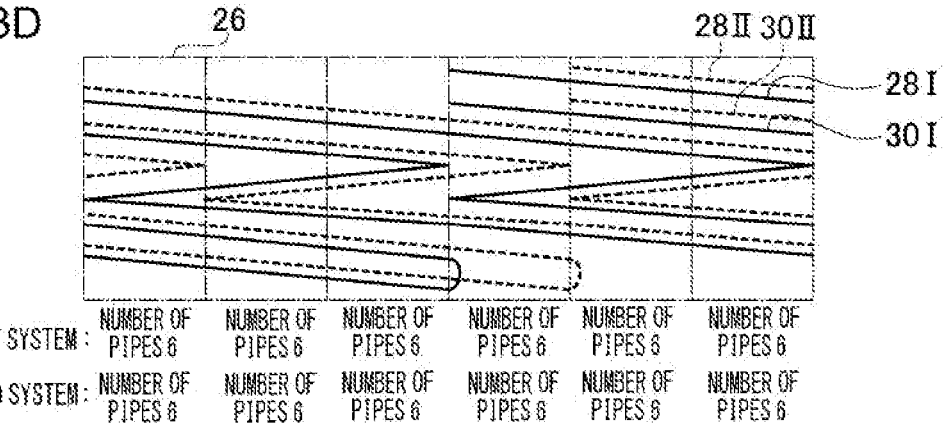

In FIG. 13D, each of the long circumference parts (40*a*I, 40*b*I, 40*a*II, 40*b*II) overlaps nine wall surfaces 26, and each of the short circumference parts (42*a*I, 42*b*I, 42*a*II, 42*b*II) overlaps six wall surfaces 26. Accordingly, the number of wall surfaces along which a short circumference part extends is 6, which satisfies the requirement of A/2×B (=6/2×2=6). Also, the difference between the number of wall surfaces along which a long circumference part extends, i.e., 9, and the number of wall surfaces along which a short circumference part extends, i.e., 6, is 3, which satisfies the requirement of A/2 (=6/2=3). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

FIGS. 14A-14D are schematic diagrams that each illustrate a state where the wall surfaces of a storage chamber are developed. In FIGS. 14A-14D, the first pipe conduit 28I and the second pipe conduit 30I in the first system 12I are indicated by solid lines, and the first pipe conduit 28II and the second pipe conduit 30II in the second system 12II are indicated by dotted lines. In FIGS. 14A-14D, A as the number of wall surfaces 26 is six. Also, the number of each of the turning parts (46*a*I, 46*b*I, 46*a*II, 46*b*II) is odd.

Figure 14A:
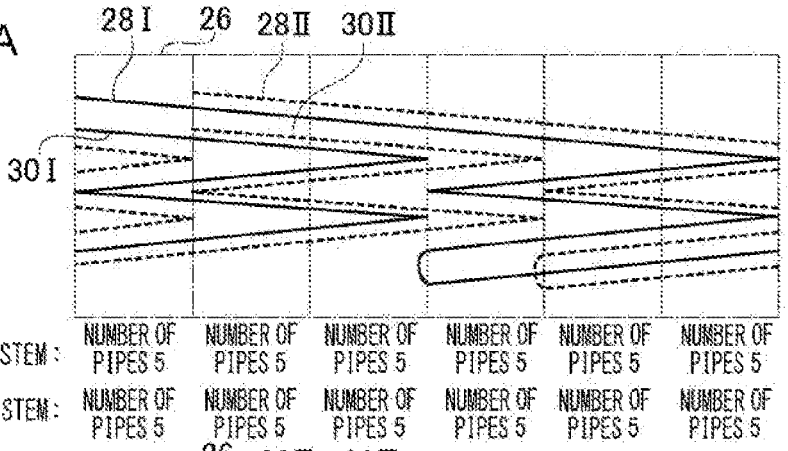
FIGS. 14A, 14B, 14C, and 14D are schematic diagrams that each illustrate a state where the wall surfaces of a storage chamber are developed.

In FIG. 14A, each of the long circumference parts (40*a*I, 40*b*I, 40*a*II, 40*b*II) overlaps six wall surfaces 26, and each of the short circumference parts (42*a*I, 42*b*I, 42*a*II, 42*b*II) overlaps three wall surfaces 26. Accordingly, the number of wall surfaces along which a short circumference part extends is 3, which satisfies the requirement of A/2×B (=6/2×1=3). Also, the difference between the number of wall surfaces along which a long circumference part extends, i.e., 6, and the number of wall surfaces along which a short circumference part extends, i.e., 3, is 3, which satisfies the requirement of A/2 (=6/2=3). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

Figure 14B:
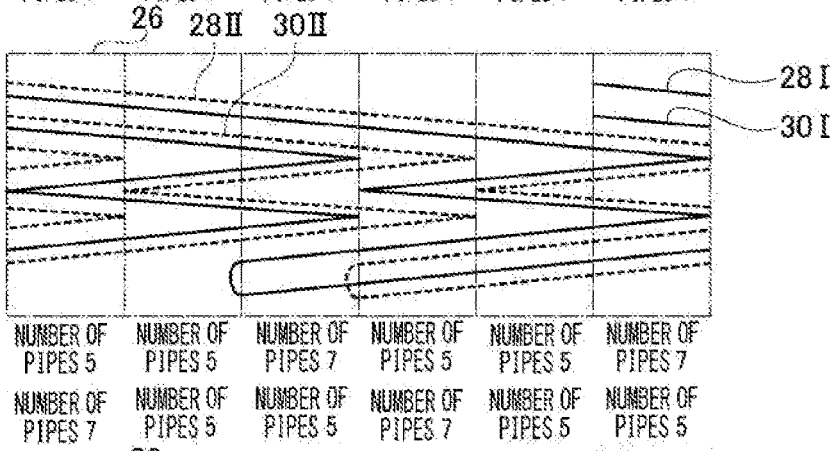

In FIG. 14B, each of the long circumference parts (40*a*I, 40*b*I, 40*a*II, 40*b*II) overlaps seven wall surfaces 26, and each of the short circumference parts (42*a*I, 42*b*I, 42*a*II, 42*b*II) overlaps four wall surfaces 26. Accordingly, the number of wall surfaces along which a short circumference part extends is 4, which does not satisfy the requirement of A/2×B (or the requirement of "B is an integer greater than or equal to 1"). Meanwhile, the difference between the number of wall surfaces along which a long circumference part extends, i.e., 7, and the number of wall surfaces along which a short circumference part extends, i.e., 4, is 3, which satisfies the requirement of A/2 (=6/2=3). In this case, the number of pipe portions overlapping each wall surface 26 is not equal in each of the first system 12I and the second system 12II. Also in the first system 12I and the second system 12II as a whole, the number of pipe portions overlapping each wall surface 26 is not equal.

Figure 14C:
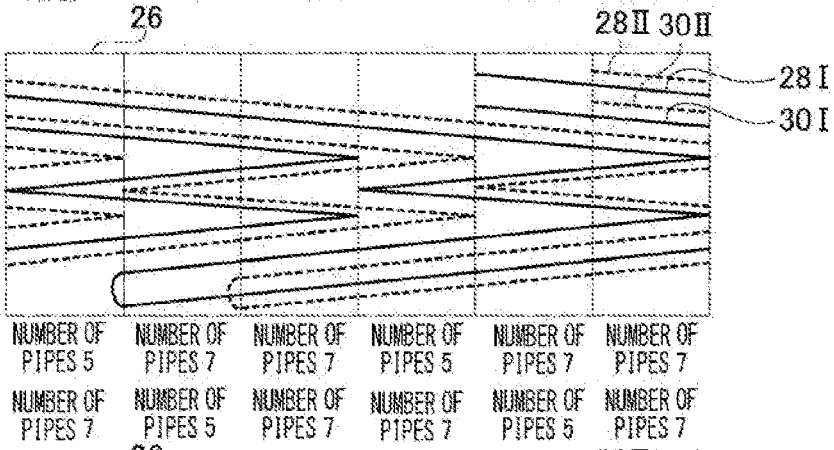

In FIG. 14C, each of the long circumference parts (40*a*I, 40*b*I, 40*a*II, 40*b*II) overlaps eight wall surfaces 26, and each of the short circumference parts (42*a*I, 42*b*I, 42*a*II, 42*b*II) overlaps five wall surfaces 26. Accordingly, the number of wall surfaces along which a short circumference part extends is 5, which does not satisfy the requirement of A/2×B (or the requirement of "B is an integer greater than or equal to 1"). Meanwhile, the difference between the number of wall surfaces along which a long circumference part extends, i.e., 8, and the number of wall surfaces along which a short circumference part extends, i.e., 5, is 3, which satisfies the requirement of A/2 (=6/2=3). In this case, the number of pipe portions overlapping each wall surface 26 is not equal in each of the first system 12I and the second system 12II. Also in the first system 12I and the second system 12II as a whole, the number of pipe portions overlapping each wall surface 26 is not equal.

Figure 14D:
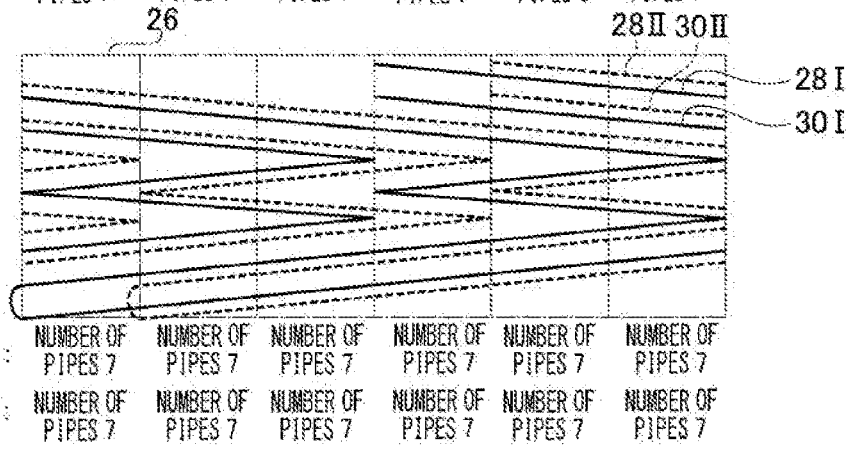

In FIG. 14D, each of the long circumference parts (40*a*I, 40*b*I, 40*a*II, 40*b*II) overlaps nine wall surfaces 26, and each of the short circumference parts (42*a*I, 42*b*I, 42*a*II, 42*b*II) overlaps six wall surfaces 26. Accordingly, the number of wall surfaces along which a short circumference part extends is 6, which satisfies the requirement of A/2×B (=6/2×2=6). Also, the difference between the number of wall surfaces along which a long circumference part extends, i.e., 9, and the number of wall surfaces along which a short circumference part extends, i.e., 6, is 3, which satisfies the requirement of A/2 (=6/2=3). In this case, the number of pipe portions overlapping each wall surface 26 is equal in each of the first system 12I and the second system 12II. Accordingly, also in the first system 12I and the second system 12II as a whole, the number of pipe portions overlapping each wall surface 26 becomes equal.

As described above, the refrigeration device 12 according to the present embodiment includes the first system 12I including the first refrigerator 14I and the first heat pipe 16I, and the second system 12II including the second refrigerator 14II, provided separately from the first refrigerator 14I, and the second heat pipe 16II. The second heat pipe 16II includes the condensation unit 20II, the pipe unit 22II, and the evaporation unit 24II, which includes the first pipe conduit 28II and the second pipe conduit 30II, and the second heat pipe 16II is connected to the second refrigerator 14II. The heat pipes (16I, 16II) of the respective systems (12I, 12II) are provided around the same storage chamber 6. Accordingly, even if one of the first system 12I and the second system 12II fails, the other system can be used to uniformly cool the storage chamber 6. Therefore, the temperature in the low-temperature storage 1 can be made more stable.

Also, in the present embodiment, the heat pipes (16I, 16II) of the respective systems (12I, 12II) are provided around the storage chamber 6 having four wall surfaces 26, and the number of each of the turning parts (46*a*I, 46*b*I, 46*a*II, 46*b*II) is even. Accordingly, the shapes of the first pipe conduit 28II and the second pipe conduit 30II in the second heat pipe 16II can be made equal to the shapes obtained by turning upside down the first pipe conduit 28I and the second pipe conduit 30I in the first heat pipe 16I. Consequently, in both the cases where the storage chamber 6 is cooled only with the first system 12I and where the storage chamber 6 is cooled only with the second system 12II, the storage chamber 6 can be equally cooled in a balanced manner. Also, the manufacturing cost of the refrigeration device 12 can be reduced, and the processes for manufacturing the refrigeration device 12 can be simplified.

Also, in the present embodiment, the first turning part 46*a*I and the second turning part 46*b*I positioned N-th counted from the condensation unit 20I side of the first heat pipe 16I (N is an integer greater than or equal to 1) and the first turning part 46*a*II and the second turning part 46*b*II positioned N-th counted from the condensation unit 20II side of the second heat pipe 16II are each disposed on a different wall surface 26. Accordingly, the first heat pipe 16I and the second heat pipe 16II can be provided around the same storage chamber 6, with minimized intersections among the pipe conduits. As a result, the storage chamber 6 can be cooled more uniformly, so that the temperature in the low-temperature storage 1 can be made more stable.

Exemplary embodiments of the present invention have been described in detail. Each of the abovementioned embodiments merely describes a specific example for carrying out the present invention. The embodiments are not intended to limit the technical scope of the present invention, and various design modifications, including changes, addition, and deletion of constituting elements, may be made to the embodiments without departing from the scope of ideas of the invention defined in the claims. Such an additional embodiment with a design modification added has the effect of each of the combined embodiments and modifications. In the aforementioned embodiments, matters to which design modifications may be made are emphasized with the expression of "of the present embodiment", "in the present embodiment", or the like, but design modifications may also be made to matters without such expression. Optional combinations of the abovementioned constituting elements may also be employed as additional aspects of the present invention. Also, the hatching provided on the cross sections in the drawings is not provided to limit the materials of the objects with the hatching.

First Modification

Figure 15:
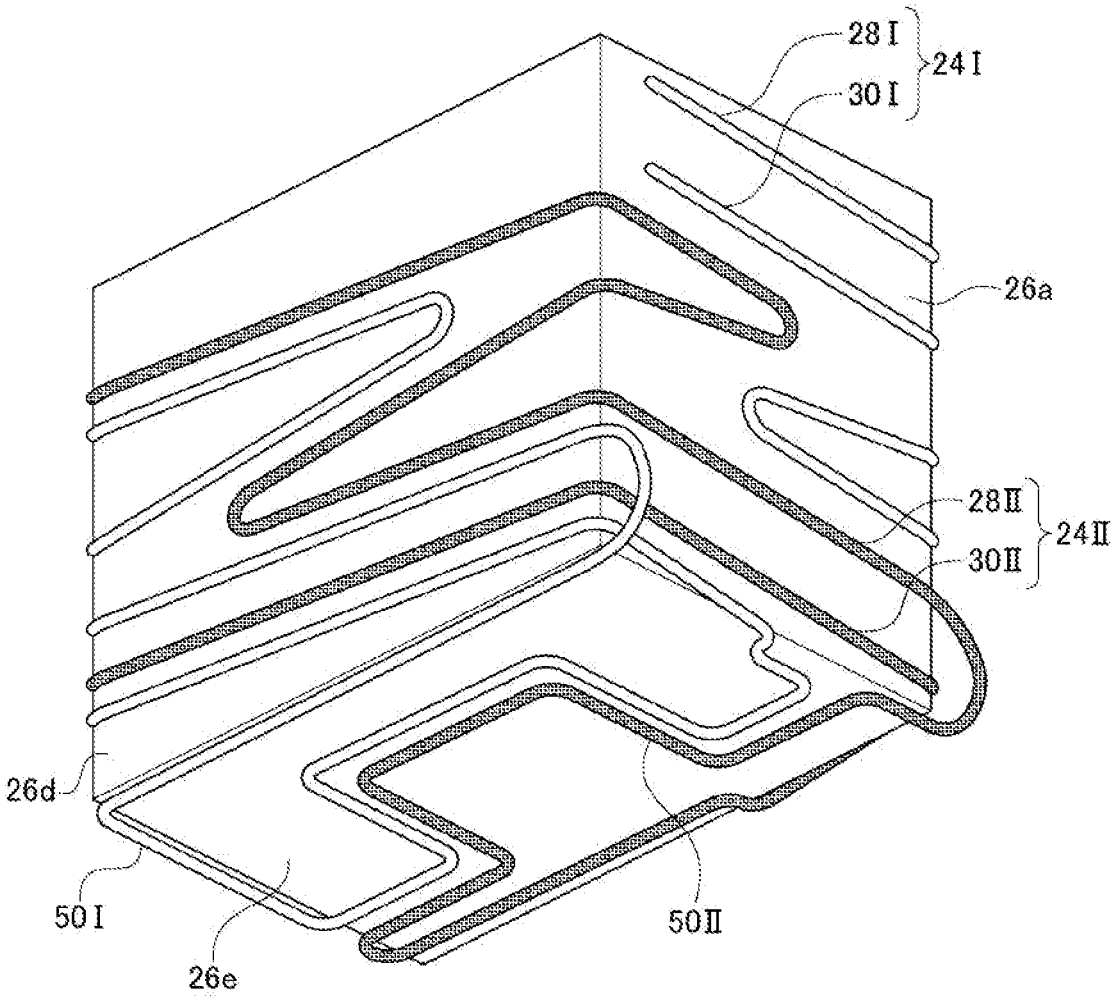
FIG. 15 is a perspective view used to describe connecting pipes provided in a refrigeration device according to a first modification.

FIG. 15 is a perspective view used to describe connecting pipes provided in a refrigeration device according to a first modification. Each of the connecting pipes (50I, 50II) in the first modification includes a portion extending along the bottom surface 26*e* of the storage chamber 6. The portions in contact with the bottom surface 26*e* are configured as the lowermost parts of the connecting pipes (50I, 50II), or the lowermost parts of the evaporation units (24I, 24II). Accordingly, the inside of the storage chamber 6 can be cooled also from the bottom surface 26*e*. Also, since the portion in contact with the bottom surface 26*e* is the lowermost part of the evaporation unit 24, even in a configuration in which a refrigerant is circulated by gravity, such as a thermosiphon, the refrigerant partially remains liquid to reach the portion in contact with the bottom surface 26*e*. The liquid refrigerant is then retained uniformly in the portion in contact with the bottom surface 26*e*, so that heat exchange with the storage chamber 6 can be performed. Accordingly, irrespective of the refrigerant circulation method, the inside of the storage chamber 6 can be cooled also from the bottom surface 26*e*. Consequently, the storage chamber 6 can be cooled more uniformly, so that the temperature in the low-temperature storage 1 can be made more stable.

Others

The refrigeration device 12 may also include a refrigerant container that is connected to the heat pipe 16 and that stores a refrigerant for the heat pipe 16. For example, the refrigerant container may be connected to the refrigerant passage of the condensation unit 20 via a pipe. The refrigerant can be transferred between the heat pipe 16 and the refrigerant container through the pipe. When the pressure within the heat pipe 16 is increased, the refrigerant partially flows from the heat pipe 16 to the refrigerant container. When the pressure within the heat pipe 16 is reduced, the refrigerant partially flows from the refrigerant container to the heat pipe 16. Accordingly, the pressure within the heat pipe 16 can be modulated.

The embodiments may be defined by the following item.

[Item 1] A low-temperature storage (1), including:

a storage chamber (6) that houses a preservation object; and a refrigeration device (12) that cools the storage chamber (6).

What is claimed is:

1. A refrigeration device, comprising:

a refrigerator; and a heat pipe comprising a condensation unit, a pipe unit, and an evaporation unit, wherein the condensation unit is connected with the refrigerator such that heat exchange therewith can be performed to condense a refrigerant, wherein the pipe unit circulates the refrigerant between the condensation unit and the evaporation unit, wherein the evaporation unit extends along wall surfaces of a storage chamber that houses a preservation object, wherein the evaporation unit is attached to the wall surfaces such that heat exchange therewith can be performed to evaporate the refrigerant, wherein the evaporation unit comprises a first pipe conduit and a second pipe conduit, wherein the first pipe conduit includes a first near-end part a first far-end part a first long circumference part, a first short circumference part, and a first junction part, wherein the first near-end part is located closer to the condensation unit than the first far-end part, wherein the first far-end part is located opposite to the first near-end part, wherein the first long circumference part, the first short circumference part, and the first junction part are arranged between the first near-end part and the first far-end part, wherein the second pipe conduit includes a second near-end part a second far-end part a second long circumference part, a second short circumference part, and a second junction part, wherein the second near-end part is located closer to the condensation unit than the second far-end part, wherein the second far-end part is located opposite to the second near-end part, wherein the second long circumference part, the second short circumference part, and the second junction part are arranged between the second near-end part and the second far-end part, wherein the first near-end part of the first pipe conduit is positioned higher than the second near-end part of the second pipe conduit, wherein the first long circumference part is located closer to the first near-end part than the first short circumference part and the first junction part, the first short circumference part is located closer to the first far-end part than the first long circumference part and the first junction part, and the first junction part is located between the first long circumference part and the first short circumference part, wherein the first long circumference part extends around the storage chamber from the first near-end part side toward the first far-end part side in a first circumference direction, wherein the first long circumference part extends along more wall surfaces than the first short circumference part, wherein the first junction part includes at least one first turning part that changes the circumference direction of the first pipe conduit, wherein the first short circumference part extends around the storage chamber from the first near-end part side toward the first far-end part side, wherein the first short circumference part extends along fewer wall surfaces than the first long circumference part, wherein the first junction part includes an even number of the at least one first turning part such that the first short circumference part extends in the first circumference direction wherein the second near-end part in the second pipe conduit is positioned lower than the first near-end part of the first pipe conduit, wherein the second short circumference part is located closer to the second near-end part than the second long circumference part and the second junction part, the second long circumference part is located closer to the second far-end part than the second short circumference part and the second junction part, and the second junction part is located between the second short circumference part and the second long circumference part, wherein the second short circumference part extends around the storage chamber from the second near-end part side toward the second far-end part side in the first circumference direction, wherein the second short circumference part extends along fewer wall surfaces than the second long circumference part, wherein the second junction part includes at least one second turning part that changes the circumference direction of the second pipe conduit, wherein a number of the at least one second turning part is equal to the number of the at least one first turning part, wherein the second long circumference part extends around the storage chamber from the second near-end part side toward the second far-end part side, wherein the second long circumference part extends along more wall surfaces than the second short circumference part, wherein the second junction part includes an even number of the at least one second turning part such that the second long circumference part extends in the first circumference direction wherein the at least one first turning part includes a first turning part positioned N-th counted from the first near-end part side and the at least one second turning part includes a second turning part positioned N-th counted from the second near-end part side, and wherein the first turning part positioned N-th counted from the first near-end part side and the second turning part positioned N-th counted from the second near-end side are disposed respectively on wall surfaces facing each other, where N is an even integer greater than or equal to 2.

2. The refrigeration device according to claim 1, wherein the heat pipe is a thermosiphon, and the first pipe conduit extends diagonally downward in a vertical direction from the first near-end part to the first far-end part, and the second pipe conduit extends diagonally downward in the vertical direction from the second near-end part to the second far-end part.

3. The refrigeration device according to claim 1, wherein the first pipe conduit and the second pipe conduit are connected to the same refrigerator.

4. The refrigeration device according to claim 1, wherein the first junction part includes a first turning pipe conduit that connects two of the even number of the at least one first turning part, and the second junction part includes a second turning pipe conduit that connects two of the even number of the at least one second turning part.

5. The refrigeration device according to claim 1, wherein, when the number of the wall surfaces of the storage chamber is defined as A each of the first short circumference part and the second short circumference part extends along wall surfaces of which the number is A/2×B, where B is an integer greater than or equal to 1, and each of i) a first difference between the number of the wall surfaces along which the first short circumference part extends and the number of the wall surfaces along which the first long circumference part extends and ii) a second difference between the number of the wall surfaces along which the second short circumference part extends and the number of the wall surfaces along which the second long circumference part extends is A/2.

6. The refrigeration device according to claim 1, wherein the first pipe conduit and the second pipe conduit have an identical entire length.

7. The refrigeration device according to claim 1, wherein the heat pipe comprises a connecting pipe that connects the first far-end part and the second far-end part.

8. The refrigeration device according to claim 1, wherein, when the refrigerator is defined as a first refrigerator and the heat pipe is defined as a first heat pipe, the refrigeration device comprises:

a first system comprising the first refrigerator and the first heat pipe; and a second system comprising a second refrigerator provided separately from the first refrigerator, and a second heat pipe that comprises a second condensation unit, a second pipe unit, and a second evaporation unit; wherein the second evaporation unit comprises a first pipe conduit and a second pipe conduit that are connected to the second refrigerator;

wherein the first and second heat pipes of the first and second systems are provided around the same storage chamber.

9. The refrigeration device according to claim 8, wherein the storage chamber includes four wall surfaces, wherein the second heat pipe further comprises first turning parts and second turning parts; wherein the number of the first turning parts of the second heat pipe and the number of the second turning parts of second heat are both even;

wherein the first pipe conduit and the second pipe conduit of the second heat pipe have shapes obtained by turning upside down the first pipe conduit and the second pipe conduit of the first heat pipe.

10. The refrigeration device according to claim 9, wherein the first turning part and the second turning part positioned N-th counted from the condensation unit side of the first heat pipe and the first turning part and the second turning part positioned N-th counted from the second condensation unit side of the second heat pipe are each disposed on a different wall surface, where N is an integer greater than or equal to 2.

11. A refrigeration device, comprising:

a refrigerator; and a heat pipe comprising a condensation unit, a pipe unit, and an evaporation unit, wherein the condensation unit is connected with the refrigerator such that heat exchange therewith can be performed to condense a refrigerant, wherein the pipe unit circulates the refrigerant between the condensation unit and the evaporation unit, wherein the evaporation unit extends along wall surfaces of a storage chamber that houses a preservation object, wherein the evaporation unit is attached to the wall surfaces such that heat exchange therewith can be performed to evaporate the refrigerant, wherein the evaporation unit comprises a first pipe conduit and a second pipe conduit, wherein the first pipe conduit includes a first near-end part, a first far-end part, a first long circumference part, a first short circumference part, and a first junction part, wherein the first near-end part is located closer to the condensation unit than the first far-end part, wherein the first far-end part is located opposite to the first near-end part, wherein the first long circumference part, the first short circumference part, and the first junction part are arranged between the first near-end part and the first far-end part, wherein the second pipe conduit includes a second near-end part, a second far-end part, a second long circumference part, a second short circumference part, and a second junction part, wherein the second near-end part is located closer to the condensation unit than the second far-end part, wherein the second far-end part is located opposite to the second near-end part, wherein the second long circumference part, the second short circumference part, and the second junction part are arranged between the second near-end part and the second far-end part, wherein the first near-end part of the first pipe conduit is positioned higher than the second near-end part of the second pipe conduit, wherein the first long circumference part is located closer to the first near-end part than the first short circumference part and the first junction part, the first short circumference part is located closer to the first far-end part than the first long circumference part and the first junction part, and the first junction part is located between the first long circumference part and the first short circumference part, wherein the first long circumference part extends around the storage chamber from the first near-end part side toward the first far-end part side in a first circumference direction, wherein the first long circumference part extends along more wall surfaces than the first short circumference part, the first junction part includes at least one first turning part that changes the circumference direction of the first pipe conduit, wherein the first short circumference part extends around the storage chamber from the first near-end part side toward the first far-end part side, wherein the first short circumference part extends along fewer wall surfaces than the first long circumference part, wherein the first junction part includes an odd number of the at least one first turning part such that the first short circumference part extends in a second circumference direction opposite the first circumference direction, wherein the second near-end part in the second pipe conduit is positioned lower than the first near-end part of the first pipe conduit, wherein the second short circumference part is located closer to the second near-end part than the second long circumference part and the second junction part, the second long circumference part is located closer to the second far-end part than the second short circumference part and the second junction part, and the second junction part is located between the second short circumference part and the second long circumference part, wherein the second short circumference part extends around the storage chamber from the second near-end part side toward the second far-end part side in the first circumference direction, wherein the second short circumference part extends along fewer wall surfaces than the second long circumference part, wherein the second junction part includes at least one second turning part that changes the circumference direction of the second pipe conduit, wherein a number of the at least one second turning part is equal to the number of the at least one first turning part, wherein the second long circumference part extends around the storage chamber from the second near-end part side toward the second far-end part side, wherein the second long circumference part extends along more wall surfaces than the second short circumference part, wherein the second junction part includes an odd number of the at least one second turning part such that the second long circumference part extends in the second circumference direction, and wherein the first turning part positioned N-th counted from the first near-end part side and the second turning part positioned N-th counted from the second near-end part side are disposed respectively on wall surfaces facing each other, where N is an odd integer greater than or equal to 1.

12. The refrigeration device according to claim 11, wherein the heat pipe is a thermosiphon, and the first pipe conduit extends diagonally downward in a vertical direction from the first near-end part to the first far-end part, and the second pipe conduit extends diagonally downward in the vertical direction from the second near-end part to the second far-end part.

13. The refrigeration device according to claim 11, wherein the first pipe conduit and the second pipe conduit are connected to the same refrigerator.

14. The refrigeration device according to claim 11, wherein, when the number of the wall surfaces of the storage chamber is defined as A, each of the first short circumference part and the second short circumference part extends along wall surfaces of which the number is $A/2\times B$, where B is an integer greater than or equal to 1, and each of i) a first difference between the number of the wall surfaces along which the first short circumference part extends and the number of the wall surfaces along which the first long circumference part extends and ii) a second difference between the number of the wall surfaces along which the second short circumference part extends and the number of the wall surfaces along which the second long circumference part extends is A/2.

15. The refrigeration device according to claim 11, wherein the first pipe conduit and the second pipe conduit have an identical entire length.

16. The refrigeration device according to claim 11, wherein the heat pipe comprises a connecting pipe that connects the first far-end part and the second far-end part.

* * * * *